US005828348A

United States Patent [19]

Tassoudji et al.

[11] Patent Number: 5,828,348

[45] Date of Patent: Oct. 27, 1998

[54] DUAL-BAND OCTAFILAR HELIX ANTENNA

[75] Inventors: Mohammad Ali Tassoudji, San Diego; James H. Thompson, Carlsbad; Randolph E. Standke, San Diego, all of Calif.

[73] Assignee: QUALCOMM Incorporated, San Diego, Calif.

[21] Appl. No.: 532,921

[22] Filed: Sep. 22, 1995

[51] Int. Cl.[6] ..... H01Q 1/36

[52] U.S. Cl. ..... 343/895; 343/853

[58] Field of Search ..... 343/895, 700 MS, 343/846, 829, 725, 853; 333/161, 117; H01Q 1/36, 11/08

[56] References Cited

U.S. PATENT DOCUMENTS

| | | | |
|---|---|---|---|
| 4,087,821 | 5/1978 | Phelan | 343/895 X |
| 4,148,030 | 4/1979 | Foldes | 343/895 |
| 4,349,824 | 9/1982 | Harris | 343/700 |
| 4,568,893 | 2/1986 | Sharma | 333/157 |
| 4,652,880 | 3/1987 | Moeller et al. | 342/373 |
| 4,717,918 | 1/1988 | Finken | 342/368 |
| 4,849,767 | 7/1989 | Naitou | 343/745 |
| 4,916,410 | 4/1990 | Littlefield | 330/295 |
| 4,928,078 | 5/1990 | Khandavalli | 333/109 |
| 4,935,747 | 6/1990 | Yuichi et al. | 343/895 |
| 4,954,790 | 9/1990 | Barber | 332/164 |
| 5,021,799 | 6/1991 | Kobus et al. | 343/795 |
| 5,036,335 | 7/1991 | Jairam | 343/767 |
| 5,041,842 | 8/1991 | Blaese | 343/882 |
| 5,132,645 | 7/1992 | Mayer | 333/109 |
| 5,138,331 | 8/1992 | Josypenko | 343/895 |
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,298,910 | 3/1994 | Takei et al. | 343/895 |
| 5,317,327 | 5/1994 | Piole | 343/725 |
| 5,329,287 | 7/1994 | Strickland | 343/752 |
| 5,343,173 | 8/1994 | Balodis et al. | 333/126 |

FOREIGN PATENT DOCUMENTS

| | | | |
|---|---|---|---|
| 0427654 | 5/1991 | European Pat. Off. | H01Q 11/08 |
| 0715369 | 6/1996 | European Pat. Off. | H01Q 11/08 |
| 3236612 | 10/1991 | Japan | H01Q 2/27 |
| 9634425 | 10/1996 | WIPO | H01Q 11/08 |

OTHER PUBLICATIONS

"A Study of the Quadrifilar Helix Antenna for Global Positioning System (GPS) Applications", *IEEE Transactions on Antennas and Propagation*, James M. Tranquilla et al., vol. 38, No. 10, Oct. 1990, 7 pages.

"Mobile Antenna Systems Hand Book", This Portion of Chapter 6, (6.5.3–6.6.2) is France Book, K. Fujimoto et al., (c) 1994, Artech House Inc.

Hisamatsu Nakano et al., "Axial Mode Helical Antennas", IEEE Transaction on Antennas and Propagation, vol. AP–34., No. 9, Sep. 1986, pp. 1143–1148.

*Primary Examiner*—Hoanganh T. Le
*Assistant Examiner*—Tho Phan
*Attorney, Agent, or Firm*—Russell B. Miller; Gregory D. Ogrod

[57] ABSTRACT

A dual-band octafilar helix antenna operational at two frequencies, while maintaining a relatively small package size. The dual-band octafilar antenna is manufactured by disposing radiators and a feed network onto a flexible substrate and forming the substrate into a cylindrical shape to obtain the helical configuration. The dual-band octafilar helix antenna includes four active radiators which are matched to a first frequency and disposed on a radiator portion of the flexible substrate. Four additional radiators, which may be either passive or active radiators, are matched to a second frequency, are also disposed on the radiator portion of the substrate and interleaved with the active radiators. At least one feed network is provided on a feed portion of the substrate that provides 0°, 90°, 180°, and 270° signals to active radiators. The sets of radiators and associated feed networks may be formed on opposing sides of a single substrate or on spaced apart layers in a multi-layered support substrate design.

(List continued on next page.)

26 Claims, 20 Drawing Sheets

U.S. PATENT DOCUMENTS

| | | | |
|---|---|---|---|
| 5,345,248 | 9/1994 | Hwang et al. | 343/895 |
| 5,349,365 | 9/1994 | Ow et al. | 343/895 |
| 5,353,040 | 10/1994 | Yamada et al. | 343/895 |
| 5,355,104 | 10/1994 | Wolfson et al. | 343/26 X |
| 5,359,340 | 10/1994 | Yokota | 343/792 |
| 5,370,677 | 12/1994 | Rudie et al. | 607/101 |
| 5,444,455 | 8/1995 | Louzir et al. | 343/895 |
| 5,510,803 | 4/1996 | Ishizaka et al. | 343/846 X |
| 5,572,227 | 11/1996 | Pal et al. | 343/895 X |
| 5,587,719 | 12/1996 | Steffy | 343/895 |

DUAL-BAND OCTAFILAR HELIX ANTENNA

BACKGROUND OF THE INVENTION

Related Applications

This application is related to commonly owned applications filed on Aug. 6, 1995 entitled "180° Power Divider for a Helix Antenna" issued Nov. 5, 1996 as U.S. Pat. No. 5,572,172, and "Quadrifilar Helix Antenna and Feed Network" and having U.S. patent application Ser. No. 08/513,317, the full disclosures of which are incorporated herein by reference as if reproduced in full below.

I. Field of the Invention

The present invention relates generally to helical antennas, and more particularly to a dual-band helical antenna having two interleaved sets of radiators, with four radiators in each set. The invention further relates to passive activation of radiator elements and single signal input feed structures.

II. Description of the Related Art

Many contemporary communications and navigation products have been developed that rely on earth-orbiting satellites to provide necessary communications and navigation signals. Examples of such products include satellite navigation systems, satellite tracking and locator systems, and communications systems which rely on satellites to relay the communications signals from one station to another. Such satellites can form part of various types of known satellite constellations and operate at various orbital altitudes, such as Low Earth Orbit (LEO), Medium Earth Orbit (MEO), or in geosynchronous orbit.

Advances in electronics in the areas of packaging, power consumption, miniaturization, and production, have generally resulted in the availability of such products in a portable package at a price point that is attractive for many commercial and individual consumers. However, one area in which further development is needed is the antenna used to provide communications with satellites. Typically, antennas suitable for use in the appropriate frequency range are larger than would be desired for use with a portable device. Often times, the antennas are implemented using microstrip technology. However, in such antennas, the feed networks are often larger than would be desired or exhibit unwanted characteristics.

Additionally, in applications where transmit and receive communications occur at different frequencies, dual-band antennas are often available only in less than desirable configurations. For example, one way in which a dual band antenna can be made is to stack two single-band quadrifilar helix antennas end-to-end, so that they form a single, common axis cylinder. A disadvantage of this solution, however, is that such an antenna is longer than would otherwise be desired for portable, or hand-held applications.

Another technique for providing dual-band performance has been to utilize two single band antennas, one tuned for each frequency. However, for hand-held units, the two antennas would have to be located in close proximity to one another. Unfortunately, two single band antennas, placed in close proximity on a portable, or hand-held create a bulky and un-aesthetic unit, which is also undesirable. At the same time, when using satellite repeaters for signal transfer, the communications signals are circularly polarized, or become so through interaction with the atmosphere, and an antenna having good circular polarization is desired.

What is needed therefore, is an antenna that operates at two frequencies and that is in a small enough package such that it is suitable for portable and/or hand-held applications. It is also desirable that the feed structure for the antenna be reduced to a single input connection for many applications.

SUMMARY OF THE INVENTION

The present invention is directed toward a dual-band octafilar helix antenna. In a preferred embodiment, the antenna radiators are etched onto a radiator portion of a microstrip substrate. Also etched onto the microstrip substrate is a feed network. For transmit operations, the feed network accepts input signals and performs necessary power division and phase control or adjustment to provide the signal phases necessary to feed the radiators of the antenna. For receive operations, the feed network accepts and combines the signals received from the radiators. The feed networks presented herein are described in terms of providing signals having appropriate relative phases to provide the transmit signals for the radiators. It should be understood that these networks also work for receiving as well.

In a preferred embodiment, the dual band antenna has four helical radiators that resonate at (are matched to) a first frequency, which are interleaved with a second set of four radiators that resonate at a second operating frequency that is different from the first frequency. An exemplary set of frequencies useful for satellite communications uses one frequency that is about one and a half times the other. The sets of radiators have different lengths to operate at the different frequencies, and can have a varied pitch near an upper end in order to tailor the radiation pattern of the antenna. This is especially applicable for the longer of the two sets where it extends beyond the other set. That is, the two sets have the same pitch where they are positioned adjacent to each other, and the longer set can have a different pitch where it extends beyond the shorter set. The two sets of interleaved radiators provide a compact form of dual-band operation.

One set of the radiators is driven actively, while the other set can either be driven passively or actively. Each set of four active radiators are connected directly to 0°, 90°, 180° and 270° signals provided by a feed network. When passive radiators are used they are not directly connected to a feed network, but are coupled to the active radiators by their close proximity.

In other aspects of the invention, the two sets of radiators and associated feed networks are mounted on one surface of a single supporting substrate, or one set of the radiators is mounted on a second opposing surface of the support substrate, which is then formed into a cylindrical shape. This latter approach allows simplified manufacturing of shorting elements connected between the radiators in some configurations. Planar ground layers are formed on the substrate on an opposite side from each feed network, as appropriate. In the alternative, the radiators and associated feed networks are mounted on surfaces of separate support substrates or substrate layers which are sandwiched on each side of a grounding layer used by the feed networks.

Various feed networks utilized to provide the interface between the feed line and the antenna elements are also disclosed. According to the feed networks described herein, three components can be utilized in various combinations to provide the 0°, 90°, 180° and 270° signals used to drive the antenna. One such component is a branch-line coupler and another is a 180° power divider. The branch line coupler accepts an input signal and splits this input signal into two output signals that are substantially equal in amplitude and differ in phase by 90°. The 180° power divider accepts an input signal and splits it into two output signals that are substantially equal in amplitude and differ in phase by 180°. The 180° power divider uses a tapered ground plane structure to convert input signals from unbalanced to balanced signals.

To provide a feed signal to, or receive a signal from, both sets of radiators at two separate frequencies the branch line couplers are implemented as double-section, broadband, branch line couplers. The branch line couplers are implemented such that the reflected energy is at or near zero for each of the two preselected operating frequencies.

Further embodiments, features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears. It should be noted that the drawings are not necessarily drawn to scale, especially where radiating portions of antennas are illustrated.

FIG. 5(*b*) illustrates the connection of a feed line to a radiator according to one embodiment.

FIG. 5(*c*) illustrates the connection of a feed line to a radiator according to an alternative embodiment.

FIG. 6(*b*) illustrates a top surface of an etched substrate of a microstrip quadrifilar helix antenna according to another embodiment.

FIG. 13(*b*) illustrates a cross-sectional view of the substrate of FIG. 13(*a*).

FIG. 19(*b*) illustrates a bottom surface of the substrate of FIG. 19(*a*).

DETAILED DESCRIPTION OF THE EMBODIMENTS

1. Overview and Discussion of the Invention

The present invention is directed toward a dual-band octafilar helix antenna and feed networks for a dual-band helix antenna. According to the dual-band antenna disclosed herein, a microstrip substrate comprises two sections: a first section having antenna radiators, and a second section having an antenna feed network. The microstrip substrate is rolled or formed into a cylindrical shape so that the radiators are helically wound about a central axis.

The feed networks comprise novel and unique structures for providing four signals of substantially equal amplitude having relative phase differences of 0°, 90°, 180° and 270° to drive a helical antenna. Two types of feed networks are disclosed: feed networks for both single and dual-band operation. To this end, for single band operation, the feed network can include a combination of components such as branch line couplers and 180° power dividers. For dual band operation, dual-band branch line couplers can be used to provide antenna signals matched to two operating frequencies.

2. Quadrifilar Helix Antennas

Figure 1:
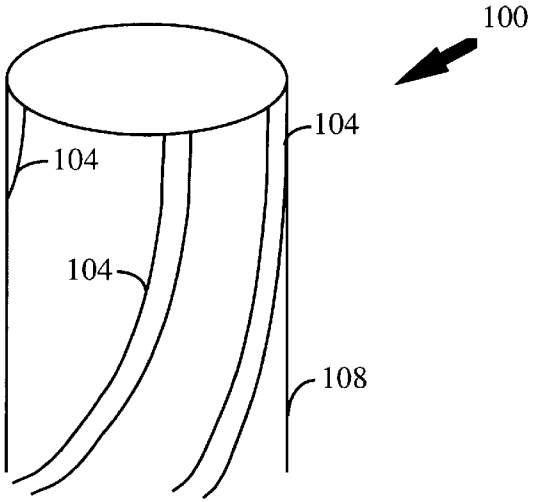
FIG. 1 illustrates a microstrip quadrifilar helix antenna.

Before describing the invention in detail, it is useful to describe an example of a quadrifilar helix microstrip antenna. Such an antenna is described with reference to FIGS. 1–6. A quadrifilar helix microstrip antenna 100 is illustrated in FIG. 1. Antenna 100 is constructed using radiators 104 etched onto a substrate 108. The substrate is a thin film flexible material that is rolled into a cylinder such that radiators 104 are helically wound about the axis of the cylinder. This cylindrical shape for the embodiments discussed below is not required to have a circular cross section. As long as the cross section represents an evenly distributed symmetrical shape, such as a rounded square, hexagon, octagon, and so forth, it is functional within the teachings of the present invention.

Figure 4:
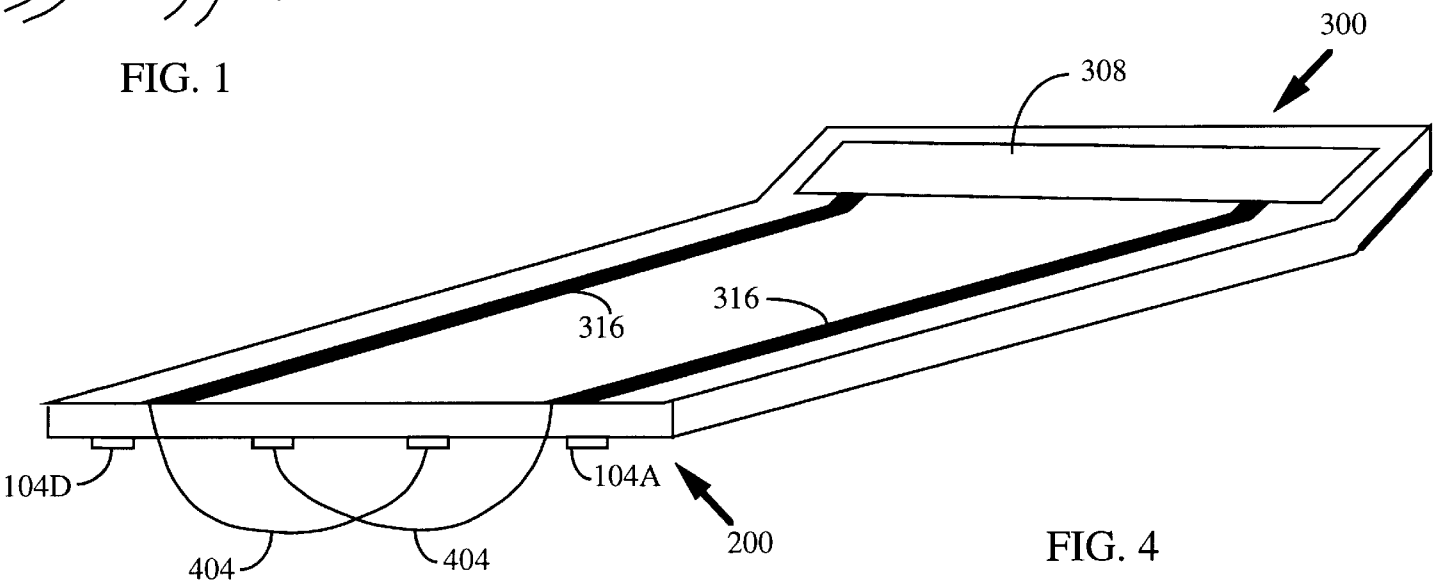
FIG. 4 illustrates a perspective view of an etched substrate of a microstrip quadrifilar helix antenna having an infinite balun feed.
Figure 3:
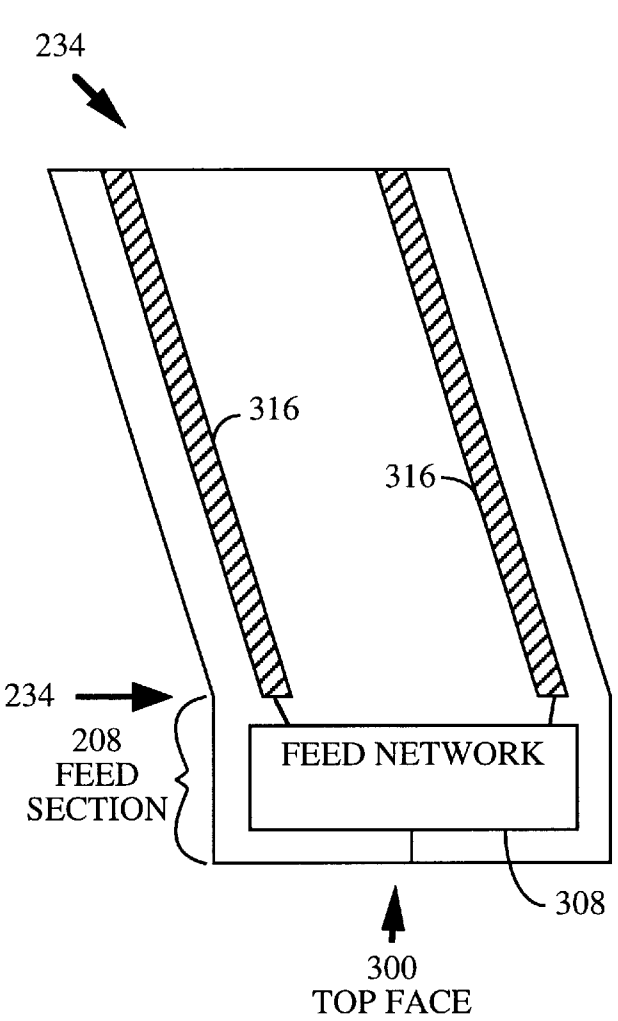
FIG. 3 illustrates a top surface of an etched substrate of a microstrip quadrifilar helix antenna having an infinite balun feed.
Figure 2:
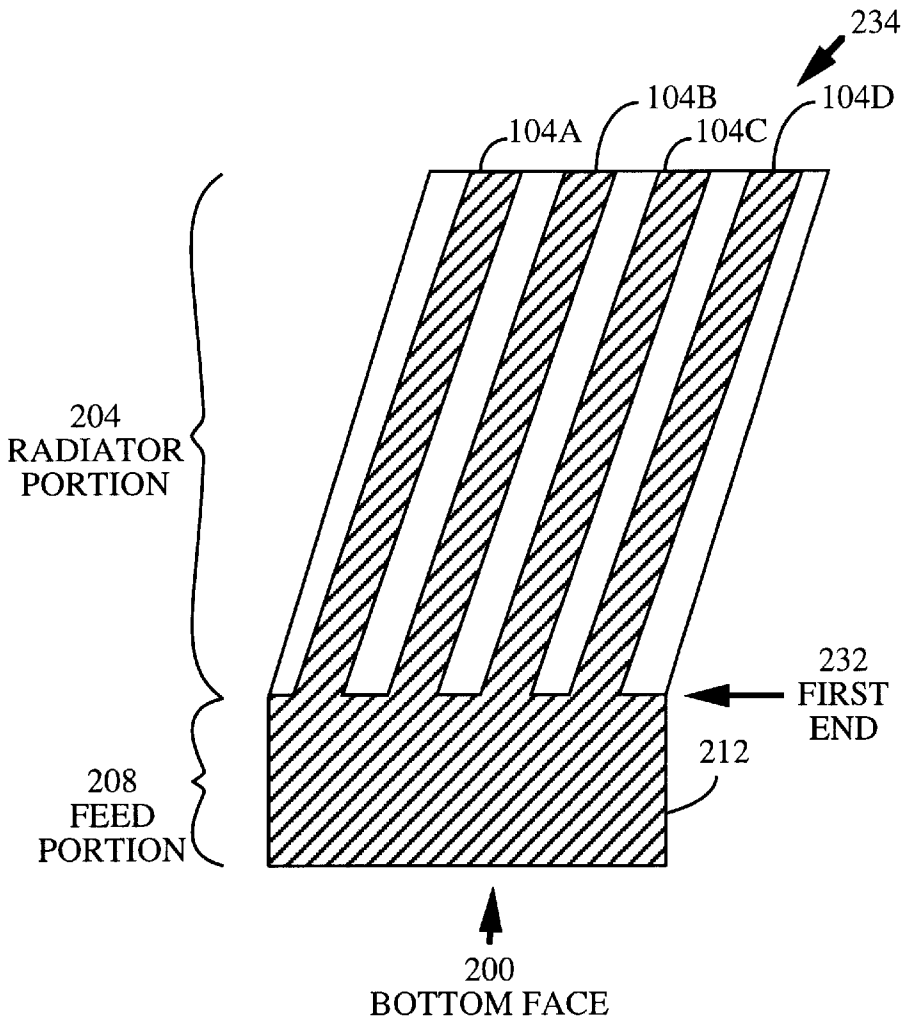
FIG. 2 illustrates a bottom surface of an etched substrate of a microstrip quadrifilar helix antenna having an infinite balun feed.

The components used to fabricate quadrifilar helix antenna 100 are illustrated in FIGS. 2–4. FIGS. 2 and 3 present a view of the bottom surface 200 and top surface 300 of substrate 108, respectively. Substrate 108 includes a radiator section 204, and a feed section 208.

Note that throughout this document, the surfaces of substrate 108 are referred to as a "top" surface and a "bottom" surface. This nomenclature is adopted for ease of description only and the use of such nomenclature should not be construed to mandate a specific spatial orientation of substrate 108. Furthermore, in the embodiments described and illustrated herein, the antennas are described as being made by forming the substrate into a cylindrical shape with the top surface being on the outer surface of the cylinder. In alternative embodiments, the substrate is formed into the cylindrical shape with the bottom surface being on the outer surface of the cylinder.

In a preferred embodiment, microstrip substrate 100 is a thin, flexible layer of polytetraflouroethalene (PTFE), a PTFE/glass composite, or other dielectric material. Preferably, substrate 100 is on the order of 0.005 in., or 0.13 mm, thick. Signal traces and ground traces are provided using copper material. In alternative embodiments, other conducting materials can be chosen in place of copper depending on cost, environmental considerations, and other factors known in the art.

An antenna embodiment having an infinite balun configuration is illustrated in FIGS. 2–5. Here, a feed network 308 is formed in feed section 208 to provide the 0°, 90°, 180°, and 270° signals that are provided to radiators 104. A ground plane 212 for feed circuit 308 is provided on bottom surface 200 of feed section 208. Signal traces for feed circuit 308 are etched onto top surface 300 of feed section 208. Specific embodiments for feed circuit 308 are described in detail below in Section 4.

For purposes of discussion, radiator section 204 has a first end 232 adjacent to feed section 208 and a second end 234 (on the opposite end of radiator section 204). Depending on the antenna embodiment implemented, radiators 104 can be etched into bottom surface 200 of radiator section 204. The length at which radiators 104 extend from first end 232 toward second end 234 depends on the feed point of the antenna, and on other design considerations such as the desired radiation pattern. Typically, this length is an integer multiple of a quarter wavelength.

In this embodiment, radiators 104 on bottom surface 200 extend the length of radiator section 204 from first end 232 to opposite end 234. These radiators are illustrated as radiators 104A, 104B, 104C, and 104D. In this infinite balun embodiment, radiators 104 are fed at second end 234 by feed lines 316 etched onto top surface 300 of radiator section 204. Feed lines 316 extend from first end 232 to second end 234 to feed radiators 104. In this configuration, the feed point is at second end 234. The surface of radiators 104A, 104D contacting substrate 108 (opposite feed lines 316) provide a ground for feed lines 316 which provide the antenna signal from the feed network to the feed point of the antenna.

Figure 5A:
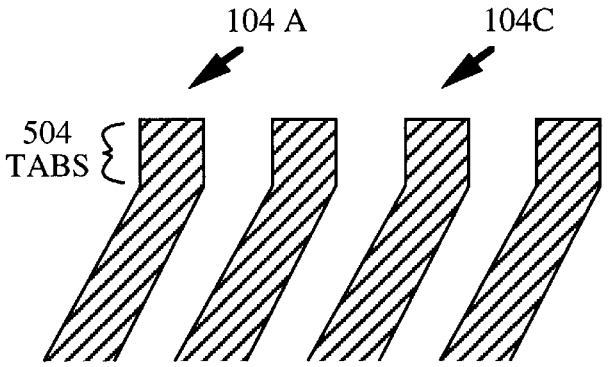
FIG. 5(*a*) illustrates tabs on the antenna radiators.
Figure 5B:
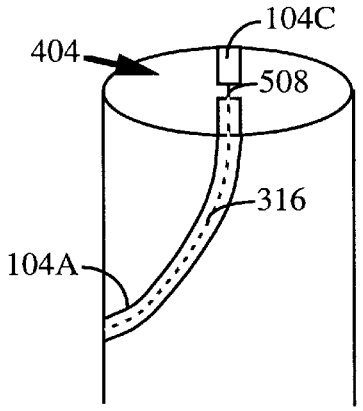
Figure 5C:
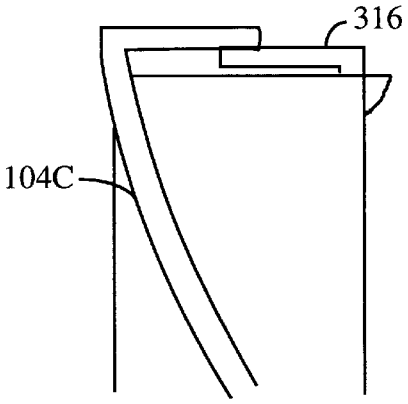

FIG. 4 is a perspective view of the infinite balun embodiment. This view further illustrates feeds 316 and radiators 104 etched onto substrate 108. This view also illustrates the manner in which feeds 316 are connected to radiators 104 using connections 404. Connections 404 are not actually physically made as illustrated in FIG. 4. FIG. 5, which comprises FIGS. 5(*a*), 5(*b*) and 5(*c*) illustrates alternative embodiments for making connections 404.

FIG. 5(*a*) is a diagram illustrating a partial view of radiator section 204. According to this embodiment, radiators 104 are provided with tabs 504 at second end 234. When the antenna is rolled into a cylinder, the appropriate radiator/feedline pairs are connected. Examples of such connection are illustrated in FIGS. 5(*b*) and 5(*c*), where tabs 504 are folded toward the center of the cylinder. In the embodiment illustrated in FIG. 5(*b*), connection 404 is implemented by soldering (or otherwise electrically connecting) radiator 104C and feed line 316 using a separate short conductor 508. In FIG. 5(*b*) feed line 316 is on the inside surface of the cylinder and is therefore illustrated as a dashed line.

In the embodiment illustrated in FIG. 5(*c*), radiator 104A and the feed line 316 on the opposite surface are folded toward the center of the cylinder, overlapped and electrically connected at the point of overlap, preferably by soldering the appropriate feed line 316 to its associated radiator 104C.

Figure 6B:
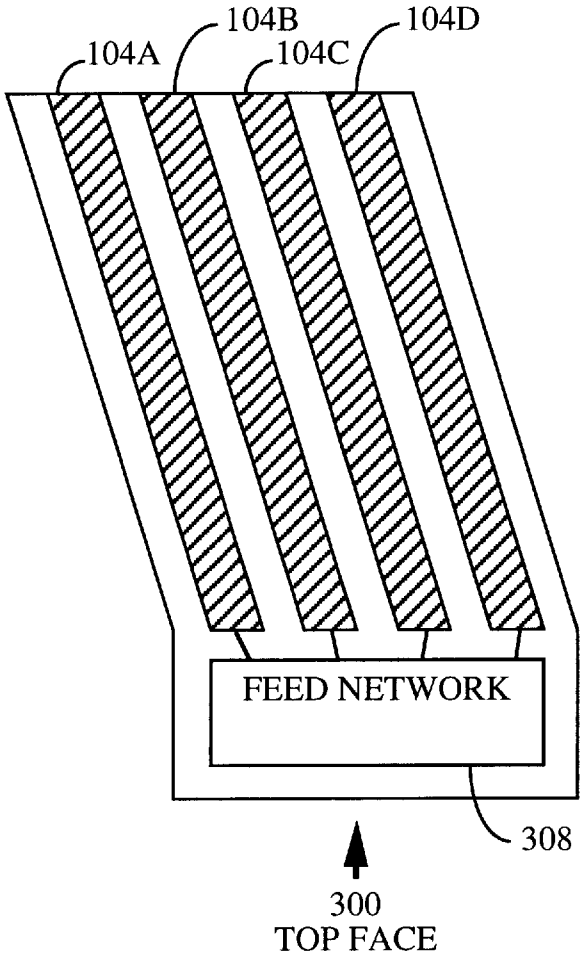
FIG. 6(*a*) illustrates a bottom surface of an etched substrate of a microstrip quadrifilar helix antenna according to another embodiment.
Figure 6A:
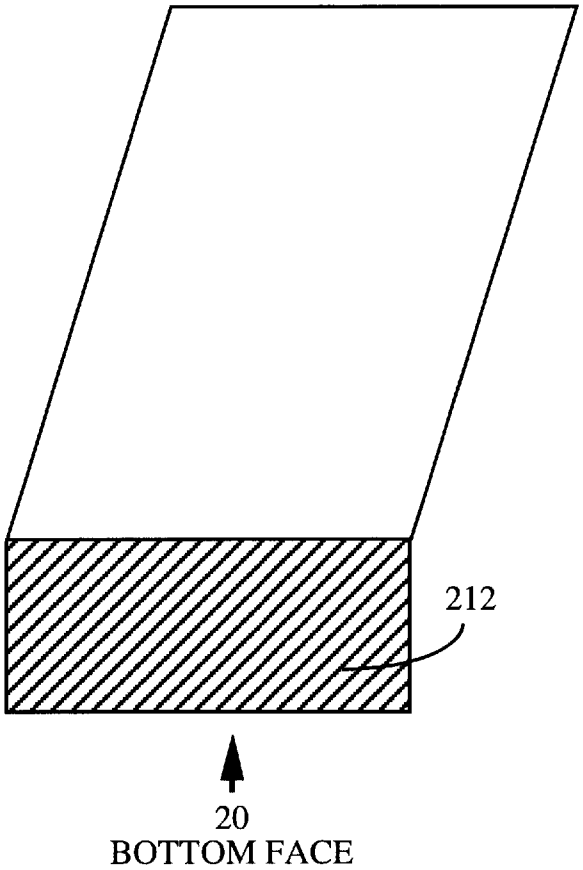

A more straightforward embodiment than the infinite balun embodiment just described, is illustrated in FIG. 6, which comprises FIGS. 6(*a*) and 6(*b*). FIG. 6(*a*) illustrates bottom surface 200; FIG. 6(*b*) illustrates top surface 300. In this embodiment, radiators 104 are etched onto top surface 300 and are fed at first end 232. These radiators are illustrated as radiators 104A, 104B, 104C, and 104D. In this embodiment, radiators 104 are not provided on bottom surface 200.

Because these radiators are fed at first end 232, there is no need for the balun feed lines 316 which were required in the infinite balun feed embodiment. Thus, this embodiment is generally easier to implement and any losses introduced by feed lines 316 can be avoided.

Figure 22:
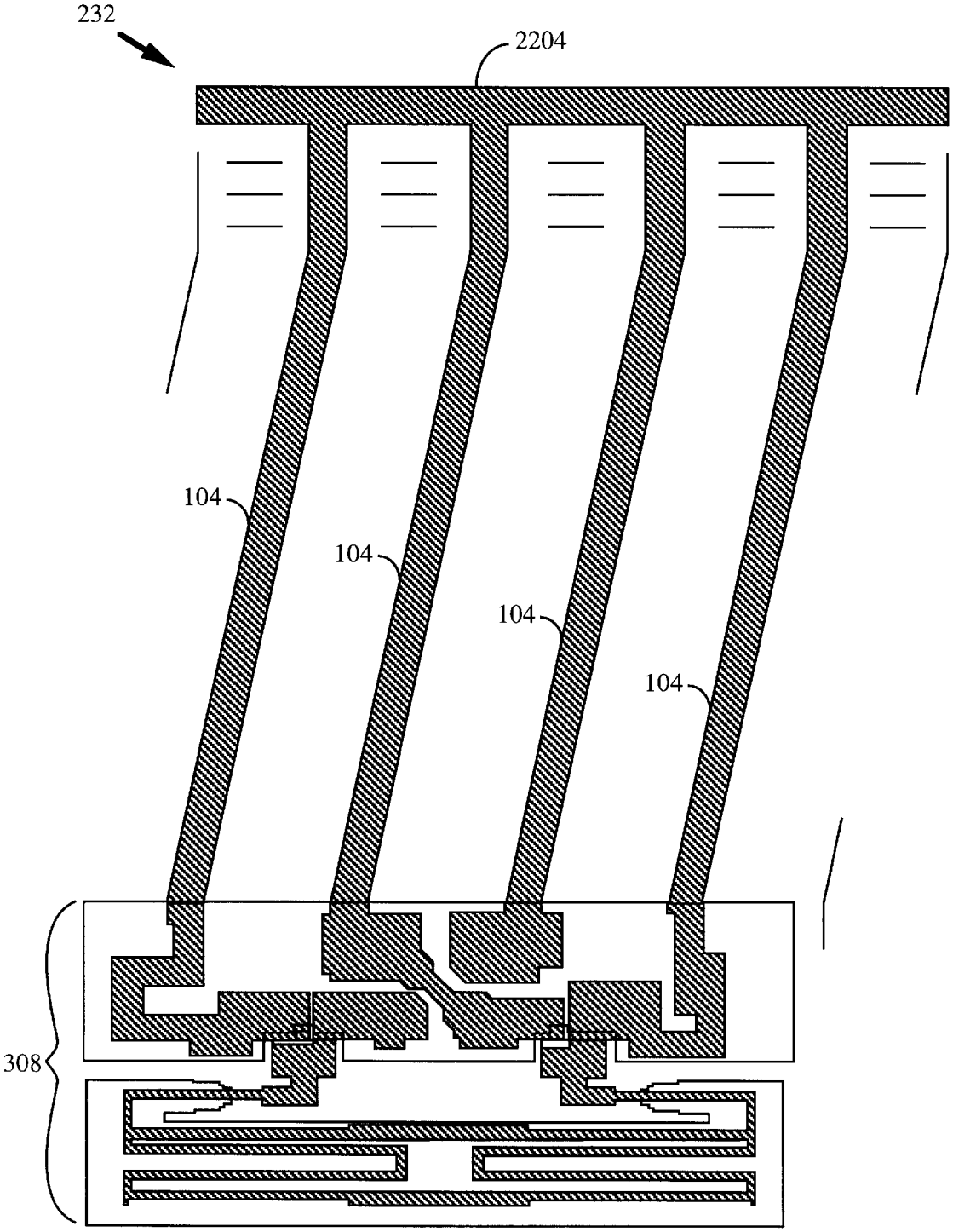
FIG. 22 illustrates an example layout of a quadrifilar helix antenna using the feed network illustrated in FIG. 21.

Note that in the embodiment illustrated in FIGS. 6(*a*) and 6(*b*), the length of radiators 104 is an integer multiple of $\lambda/2$, where $\lambda$ is the wavelength of the center frequency of the antenna. In such an embodiment where radiators 104 are an integer multiple of $\lambda/2$, radiators 104 are electrically connected together at second end 234. This connection can be made by a conductor across second end 234 which forms a ring around the circumference of the antenna when the substrate is formed into a cylinder. An example of this embodiment is illustrated in FIG. 22. In an alternative implementation where the length of radiators 104 is an odd integer multiple of $\lambda/4$, radiators 104 are left electrically open at second end 234 to allow the antenna to resonate at the center frequency.

3. Branch Line Couplers

Figure 7:
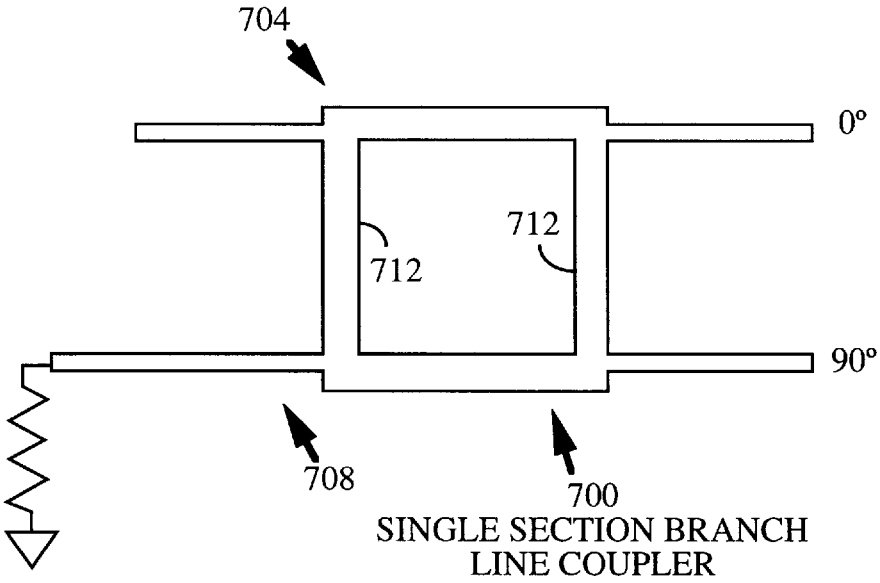
FIG. 7 illustrates a single-section branch line coupler exhibiting narrow-band frequency response characteristics.

Branch line couplers have been used as a simple and inexpensive means for power division and directional coupling. A single section, narrow band branch line coupler 700 is illustrated in FIG. 7. Coupler 700 includes a mainline branch arm 704, a secondary branch arm 708 and two shunt branch arms 712. The input signal is provided to mainline branch arm 704 (referred to as mainline 704) and coupled to secondary branch arm 708 (referred to as secondary line 708) by shunt branch arms 712. Secondary line 708 is connected to ground at one end with a matched terminating impedance. Preferably, shunt branch arms 712 are one quarter-wavelength long sections separated by one quarter wavelength, thus forming a section having a perimeter length of approximately one wavelength.

At the output, mainline 704 and secondary line 708 each carries an output signal. These signals differ in phase from each other by 90°. Both outputs provide a signal that is roughly half of the power level of the input signal.

Figure 8:
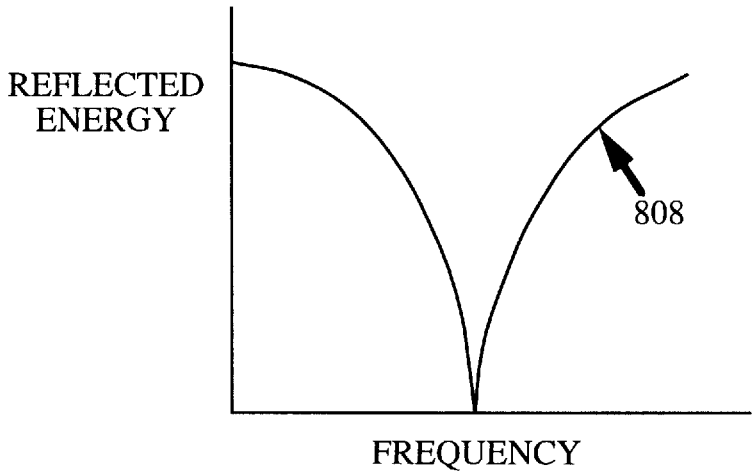
FIG. 8 illustrates the frequency response of the single-section branch line coupler of FIG. 7.

One property of such a single-section branch line coupler 700 is that its frequency response is somewhat narrow. FIG. 8 illustrates the frequency response 808 of a typical single-section branch line coupler 700 in terms of reflected energy. That is, how the amount of reflected energy changes with frequency.

Figure 9:
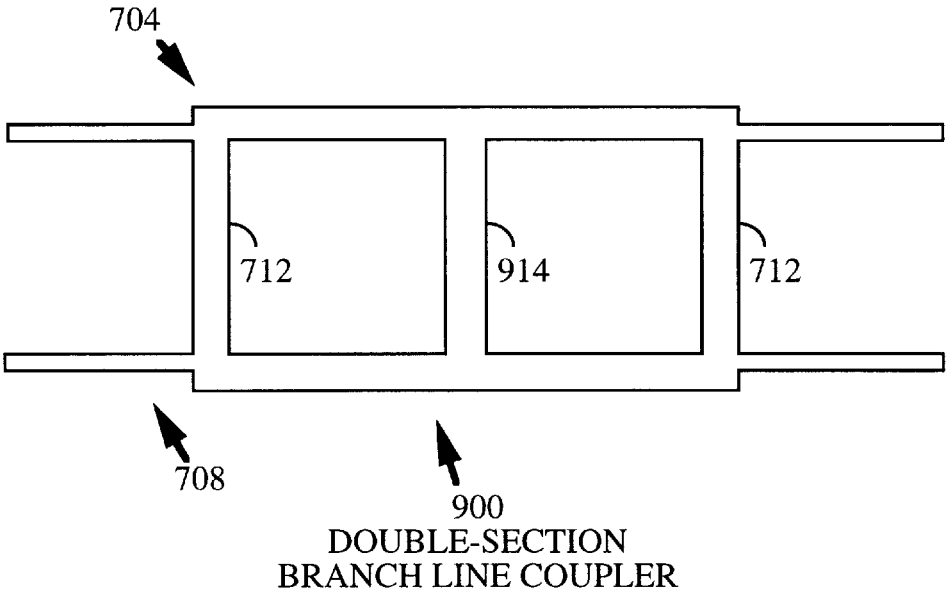
FIG. 9 illustrates a double-section branch line coupler exhibiting broadband/dual-band frequency response characteristics.

To accommodate a broader range of frequencies, a double-section branch line coupler can be implemented. Such a double-section branch line coupler 900 is illustrated in FIG. 9. A primary physical distinction between single-section branch line coupler 700 and double-section branch line coupler 900 is that double-section branch line coupler 900 includes an additional shunt branch arm 914.

Figure 10:
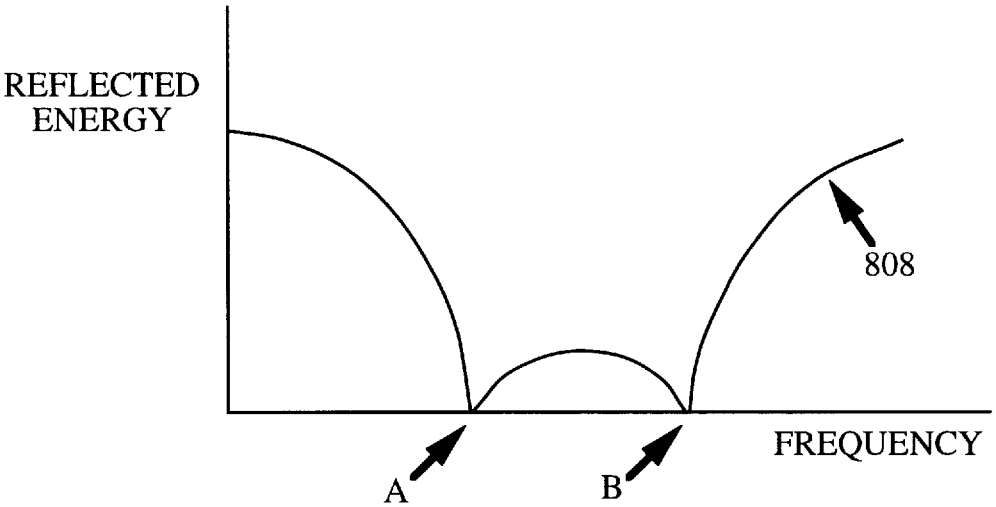
FIG. 10 illustrates the frequency response of the double-section branch line coupler of FIG. 7.

An advantage of double-section branch line coupler 900 over single-section branch line coupler 700, is that the double-section branch line coupler 900 provides a broader frequency response. That is, the frequency range over which the reflected energy is below an acceptable level is broader than that of the single-section branch line coupler 700. The frequency response for a typical double-section branch line coupler is illustrated in FIG. 10. However, for true broadband applications, the double-section branch line coupler 900 is still not perfectly ideal due to the level of reflected energy encountered in the operating frequency range.

However, for dual-band applications requiring performance optimized for narrow bandwidths around two operating frequencies, this frequency response curve is ideal as it has two frequencies where the level of reflected energy is at, or at least very near, zero. This is illustrated by points A and B in FIG. 10.

4. Feed Networks

The quadrifilar helix antennas described above in Section 2 as well as the dual-band antennas described below in Section 5 require a feed network to provide the 0°, 90°, 180° and 270° signals needed to drive antenna radiators 104. Described in this Section 4 are several feed networks that can be implemented to perform this interface between radiators 104 and the feed line to the antenna. The feed networks are described in terms of several components: a 180° power divider, single-section branch line couplers 700 and double-section branch line couplers 900. These devices have proven useful in implementing the teachings of the invention. However, those skilled in the art will appreciate that other known signal transfer structures besides those illustrated herein can be used. The antenna simply requires production of four signals for each set of active radiators with substantially equal power and appropriate phase relationships. The choice of a specific feed network structure depends on design factors known by those skilled in the art, such as manufacturability, reliability, cost, and so forth.

One element used in providing the needed phases is a 180° power divider. An exemplary 180° power divider is described in further detail in the patent applications incorporated above. This type of 180° power divider accepts an input signal along a conductive path and splits it into two signals of substantially equal amplitude that differ in phase by 180°. This is accomplished by using a tapered ground layer adjacent to the conductor so that the input signal makes a transition between a balanced signal and an unbalanced signal.

The input signal transitions from an unbalanced to a balanced signal as it travels along the conductive path opposite the tapered ground. This transition creates current flowing on a return conductive path that is equal and opposite to the current in conductive path. Thus, the signal on the return conductive path is 180° out of phase with the signal on conductive path. By tapping into both the return and input signal paths, two signals are available, one as the 0° signal and the other as the 180° signal. Appropriate vias, plated-through holes, or similar techniques, can be used to transfer the 180° signal through the substrate for coupling to the appropriate antenna radiators.

For proper operation of a quadrifilar or octafilar helix antenna such as those described herein, the transmitted signal must be divided into 0°, 90°, 180° and 270° signal. Similarly, the received 0°, 90°, 180° and 270° signals must be combined into a single receive signal. To accomplish this, feed circuit 308 is provided. In this section, several embodiments of feed circuit 308 are disclosed. These embodiments use a combination of the 180° power divider and the branch line couplers described above in Section 3 of this document.

Figure 11:
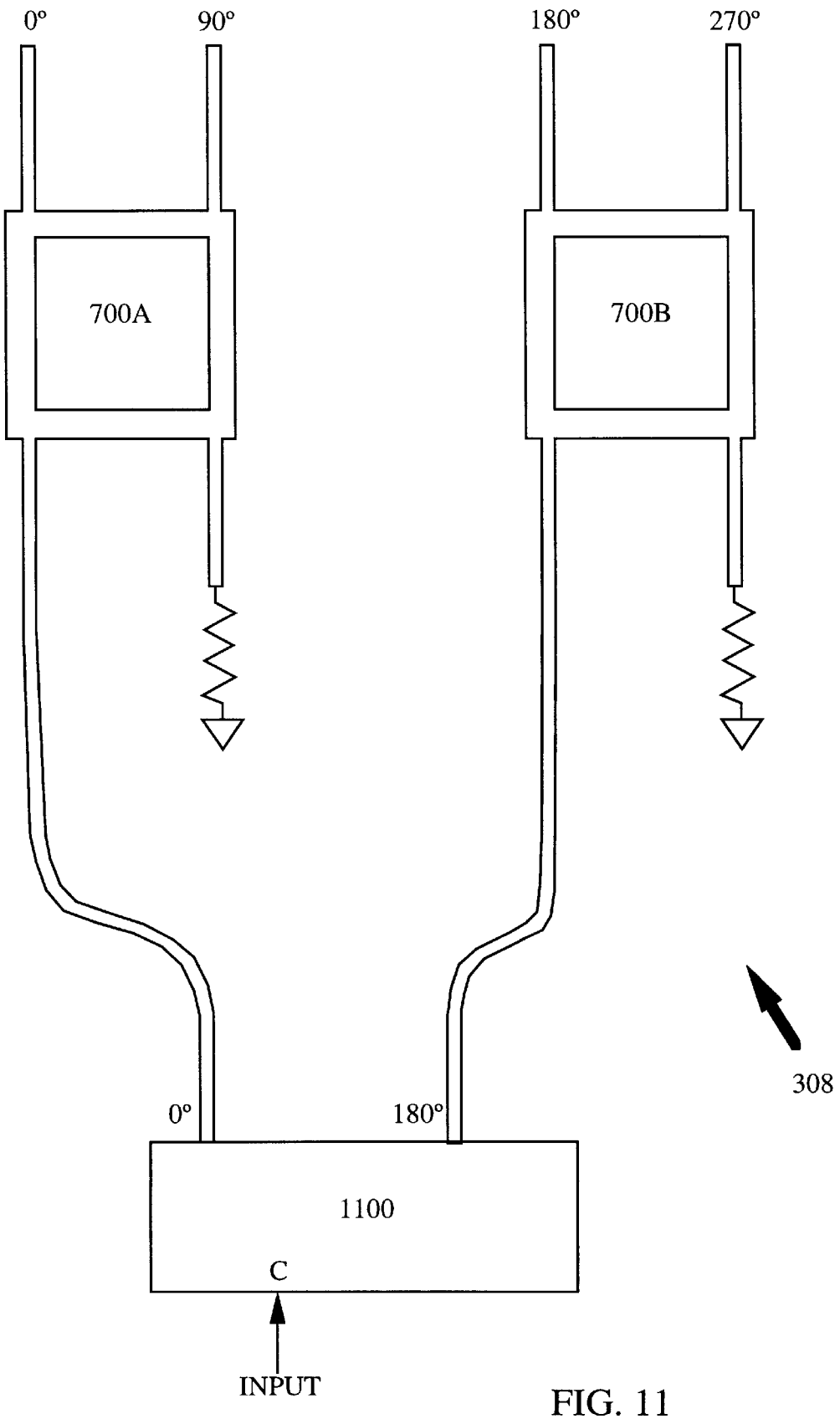
FIG. 11 illustrates a narrow-band feed network having a 180° power divider and two branch line couplers according to one embodiment of the invention.

A first embodiment of feed circuit 308 combines two branch line couplers 700 and one 180° power divider. This embodiment is illustrated in FIG. 11. According to this embodiment, an input signal is provided to the feed network at a connection or input point C. A 180° power divider 1100 then splits the input signal into two signals that differ in phase by 180°. These are referred to as a 0° signal and a 180° signal. Each of these signals is fed into a single-section branch line coupler 700. Specifically, the 0° signal is fed into branch line coupler 700A, and the 180° signal into branch line coupler 700B.

Branch line couplers 700A, 700B each provide two outputs that are of equal amplitude but that differ in phase by 90°. These are referred to as a 0° signal and a 90° signal. Because the input to branch line coupler 700A differs from the input to branch line coupler 700B by 180°, the 0° and 90° output signals from branch line coupler 700A differ from the 0° and 90° output signals from branch line coupler 700B by 180°. As a result, at the output of the feed network are the 0°, 90°, 180° and 270° signals required to feed the quadrifilar antenna. Each of these 0°, 90°, 180° and 270° signals is fed to radiators 104A, 104B, 104C, and 104D, respectively.

Figure 12:
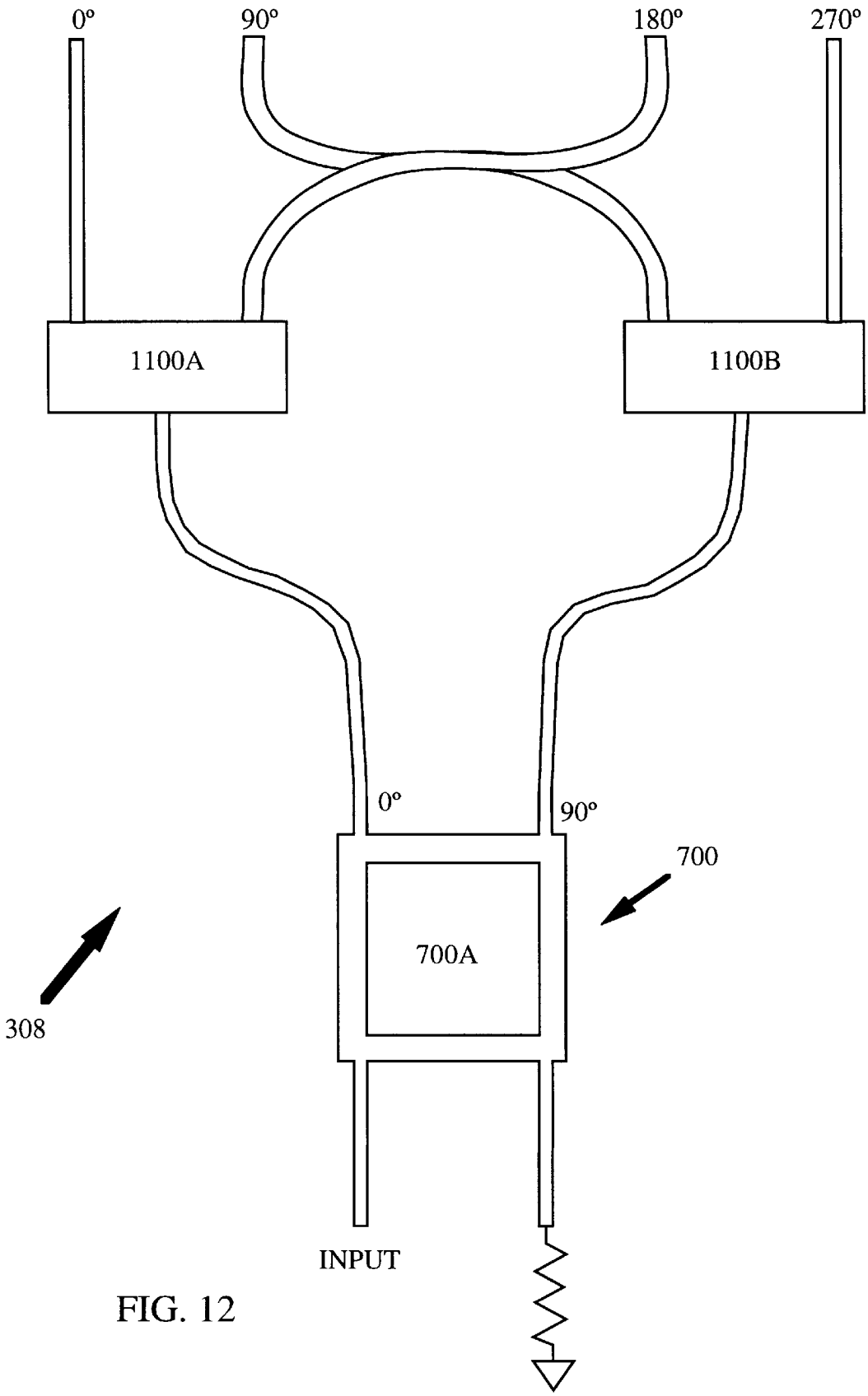
FIG. 12 illustrates a narrow-band feed network having two 180° power dividers and a branch-line coupler according to one embodiment of the invention.

A second embodiment of feed circuit 308, illustrated in FIG. 12 uses two 180° power dividers 1100 and one single-section branch line coupler 700. According to this embodiment, single-section branch line coupler 700 first splits the input signal to form two output signals of equivalent amplitude that differ from each other by 90°. These 0° and 90° degree output signals are fed into 180° power divider 1100A and 180° power divider 1100B, respectively. Because each 180° power divider 1100 produces two outputs that are of equal amplitude but that differ in phase by 180°, the outputs of the two 180° power dividers 1100 are the 0°, 90°, 180° and 270° signals.

Note, however, that these signals are not in the correct order. 180° power divider 1100A provides the 0° and 180° signals, while 180° power divider 1100B provides the 90° and 270° signals. Thus, to provide the signals to radiators 104 in the correct order, the 90° and 180° conductive paths must change relative positions. One way to change the relative position of the signals is to feed one of these two signals to bottom surface 200 until it passes across the other signal.

At this position the signal trace is etched as a patch on bottom surface 200. Around the patch is a clearing where there is no ground plane. This clearing, however, has a negative impact on the ground. Therefore, it is desirable to leave the ground as a continuous plane without any clearing whatsoever.

In an alternative embodiment, the signal positions are exchanged by running one conductive path across the other conductive path with an insulating bridge between the two conductive paths. This allows the ground plane to be continuous. In yet another alternative embodiment, the crossing is made by running the signal trace across the ground plane using an insulating section between the crossing signal and the ground plane. In this alternative, the only interruption is for the vias allowing the signal to pass through the ground plane.

Another embodiment of feed circuit 308, uses one branch line coupler to feed two infinite balun fed antenna structures as shown in FIGS. 2 and 3 above. This is shown in further detail below in FIG. 15. According to this embodiment, a branch line coupler 700 first splits the input signal to form 0° and 90° degree output signals which are fed into the top ends of the radiators 104 away from feed network 308. As discussed above, this feed method results in a 180° phase difference in the signals developed on each pair of radiators being fed, thus, providing the desired 0°, 90°, 180°, and 270° signals, as discussed above relative to FIGS. 2–5.

Although feed circuit 308 is described herein in terms of a quadrifilar helix antenna requiring 0°, 90°, 180° and 270° signals, after reading the above description, it will be apparent to a person skilled in the art how to implement the disclosed techniques with other antenna configurations.

5.0 Dual-Band Octafilar Helix Antenna

There are a number of applications where a dual-band antenna is required. One such application is a satellite communication system where the uplink is on one frequency and the downlink is on a second frequency. One way of providing a dual-band antenna is to stack two helix antennas end-to-end, where one of the stacked antennas resonates at the first frequency and the other resonates at the second frequency. However, a disadvantage of this solution is that the overall length of such a stacked antenna would be undesirable for many portable or hand-held applications. To avoid the stacked configuration, one of the two antennas could be positioned within and coaxially with the other antenna. Although this second approach avoids the problem of unwanted length, the antenna patterns would, under certain conditions, interfere with one another in an undesirable manner.

Figure 13A:
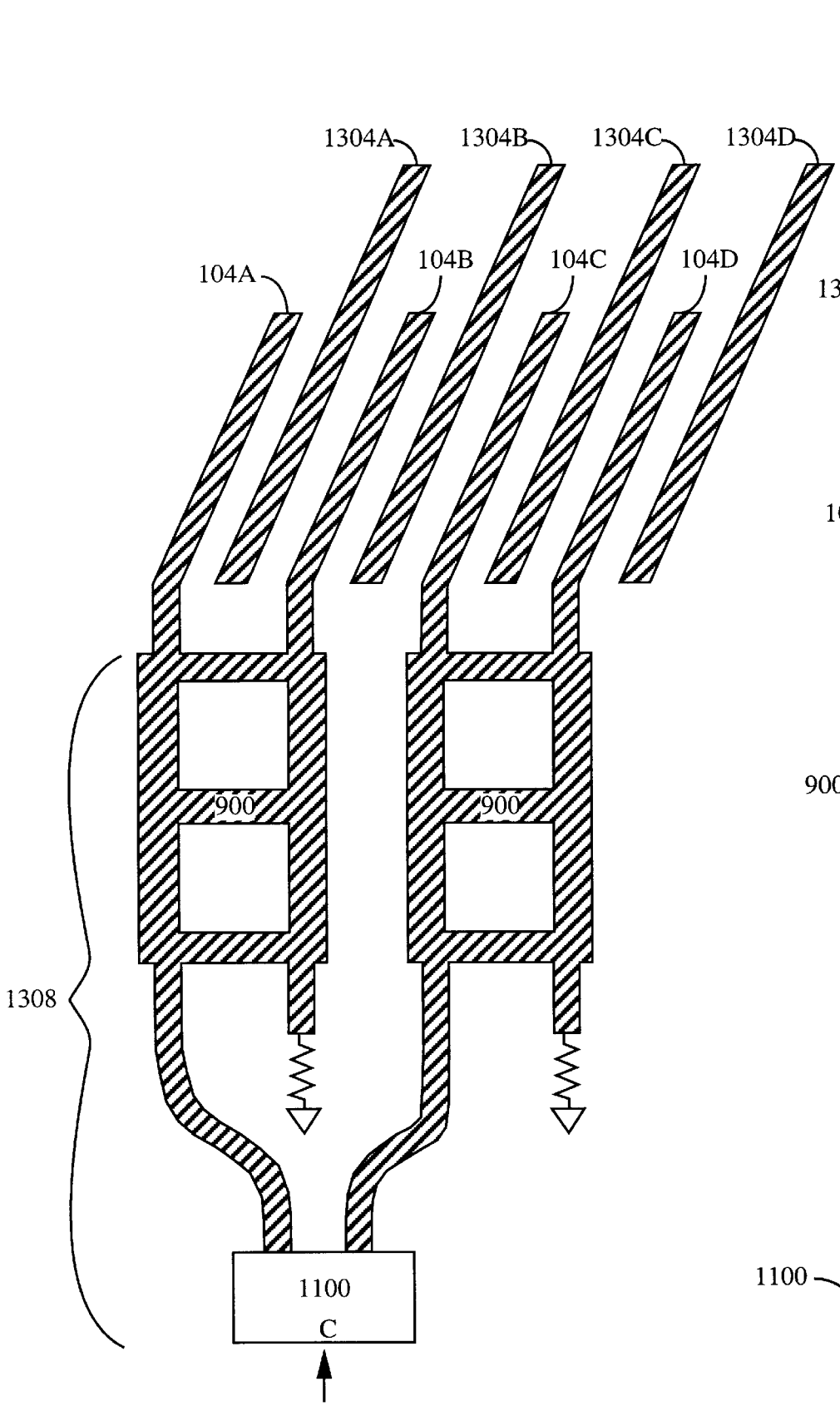
FIG. 13(*a*) illustrates a top surface of the substrate of a microstrip dual-band octafilar antenna having a dual-band feed network.
Figure 13B:
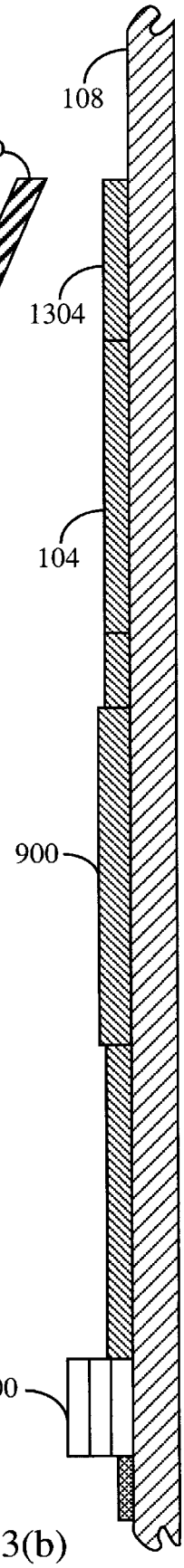

A dual-band antenna that avoids the problems of the above-mentioned alternatives is a dual-band octafilar antenna. The etched microstrip substrate used to fabricate such a dual-band octafilar antenna is illustrated in FIG. 13, using a top view in FIG. 13(*a*) and a cross section in FIG. 13(*b*). In FIG. 13, the antenna comprises two sets of radiators 104, 1304. A first set of radiators 104, labeled 104A, 104B, 104C and 104D, are radiators that resonate at a first frequency (i.e. active resonators 104 are matched to a first frequency). The second set of radiators, labeled 1304A, 1304B, 1304C, and 1304D, are radiators that resonate at (are matched to) a second frequency, different from the first frequency.

Radiators 1304 can be driven either passively or actively, depending on various manufacturing requirements, power limitations, volumetric constraints, or other design parameters known in the art. As is illustrated in FIG. 13, radiators 1304 are interleaved with radiators 104. Although, radiators 1304 may be formed on another surface of substrate 108, or another substrate entirely, from radiators 104, as discussed further below.

A dual-band octafilar antenna arrangement is shown in FIG. 13 using passive radiators 1304 and active radiators 104. As with the quadrifilar antenna described above, the dual-band antenna utilizes a feed network 1308 and radiators 104, 1304 are etched onto a microstrip substrate and the substrate is formed into a cylinder.

Also illustrated in FIG. 13 is one embodiment of a feed network 1308 that is used to feed the dual-band octafilar antenna. According to this embodiment, feed network 1308 includes two double-section branch line couplers 900 and a 180° power divider 1100. The operation of the feed network 1308 of this embodiment is similar to that of the embodiment of feed network 308 illustrated in FIG. 11. The primary difference being the use of double-section branch line couplers 900 in lieu of single-section branch line couplers 700. In an alternative embodiment, the feed network implemented could also be that feed network illustrated in FIG. 12, also with double-section branch line couplers 900 in place of single section branch line couplers 700.

Because of the frequency response characteristics of double-section branch-line couplers 900, they are suitable for operation with antennas at two frequencies. Specifically, if double-section branch line couplers 900 are implemented such that the operating frequencies of the antenna are substantially near frequencies represented by points A and B in FIG. 10, there is little or no reflected energy at these frequencies. In other words, double-section branch line couplers 900 are implemented such that one of points A and B substantially coincides with the resonant frequency of active radiators 104 and the other with passive radiators 1304.

Figure 14:
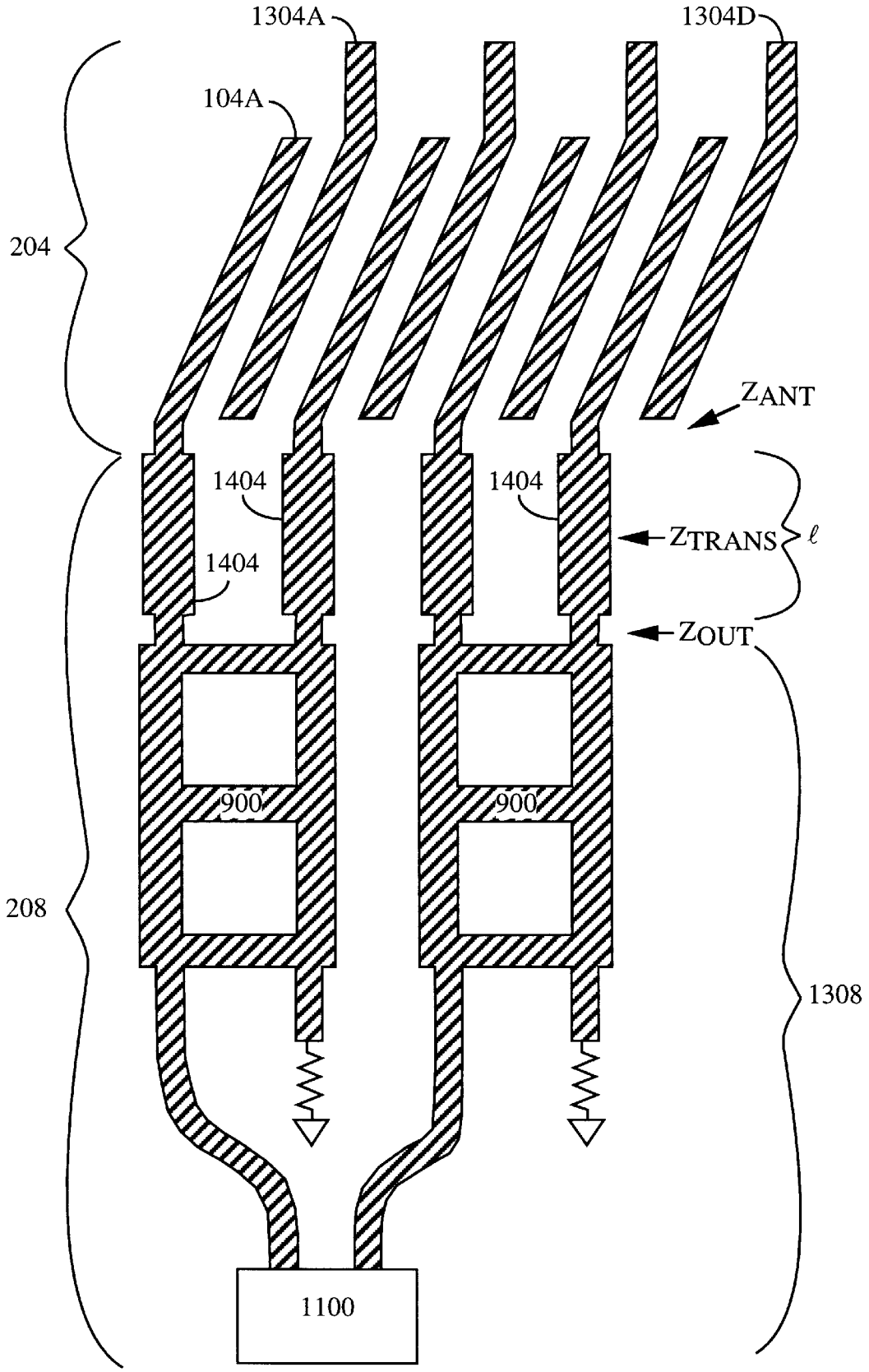
FIG. 14 illustrates a top surface of the substrate of a microstrip dual-band octafilar antenna having a dual-band feed network and impedance transformers.

In order to optimize the performance of the octafilar antenna, the impedance of the input signal source is matched to the impedance of the active radiators 104 in the presence of passive radiators 1304, at both frequencies. One way in which this is accomplished is through the use of transformer sections between double-section branch line couplers 900 and active radiators 104. This is illustrated in FIG. 14 where, in this embodiment, feed network 1308 comprises one 180° power divider 1100, two branch line couplers 900, and four transformers 1404.

In one embodiment of the dual-band octafilar antenna, the operating frequencies are chosen such that one frequency is approximately one and a half times the other frequency. In this embodiment, transformers 1404 are implemented as transmission line segments, where the length of each segment is approximately $\lambda/2$ of the lower frequency and $3\lambda/4$ of the higher frequency. The output impedance $Z_{out}$ of branch line coupler 900 is matched to the antenna impedance $Z_{ant}$ of active radiators 104 in the presence of passive radiators 1304, at the lower frequency.

The feed network according to this embodiment is best described in terms of an example implementation. In this example, one frequency, 1.618 GHz, is used for transmission and the other, 2.492 GHz for reception. These are the points A and B referred to earlier with respect to FIG. 10. The impedance of active or driven radiators 104, with passive radiators 1304 present, is matched at the two frequencies, or within the two narrow bands about those frequencies. To match the impedance of the feed network 1308 to radiators 104, 1304, transformers 1404 are implemented as having a length $l \approx \lambda/2$ at 1.618 GHz, or $l \approx 3\lambda/4$ at 2.492 GHz. At this length, the transformer does not alter the impedance seen at 1.618 GHz, and therefore, $Z_{out}$ still matches $Z_{ant}$. However, for the 2.492 GHz frequency, because transformer 1404 is 3λ/4, transformer 1404 functions as a quarter-wave transformer having a characteristic impedance:

$$Z_{trans} = \sqrt{Z_{out} * Z_{ant@2.492}}$$

Therefore, to match the impedance of the antenna, $Z_{ant}$, to the impedance of double-section branch line coupler 900, $Z_{out}$, the above relationship is used to determine the impedance, $Z_{trans}$, of transformer 1404. Once $Z_{trans}$ is determined, transformers 1404 can be implemented using known design techniques to obtain this value. The appropriate $Z_{trans}$ is obtained by altering the width of the traces used to implement transformers 1404.

Figure 15:
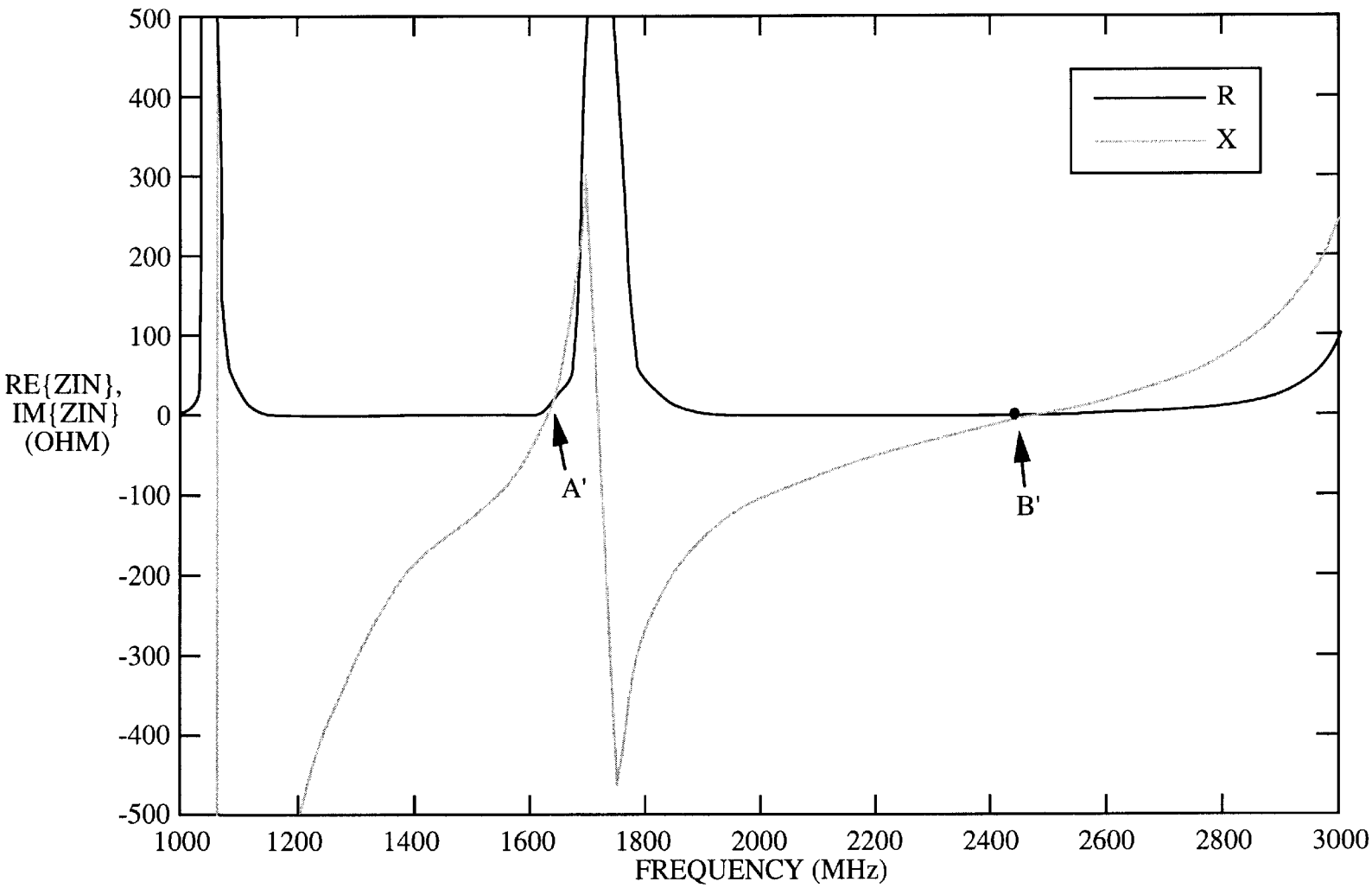
FIG. 15 illustrates a plot of radiation element impedance versus frequency for an octafilar antenna according to one embodiment of the invention.

A graphic plot of the variation in antenna impedance over a broad continuous range of frequencies, which includes the two narrow frequency bands of interest, is shown in FIG. 15. In FIG. 15, the solid line represents the real portion of the impedance of an exemplary antenna while the dashed line represents the imaginary portion of the impedance. The point at which the imaginary portion crosses through zero impedance is considered the resonant frequency of the antenna. In FIG. 15, the imaginary curve intersects zero at the two desired frequencies, about 1.618 GHz for transmission and 2.492 GHz for reception, as denoted by the points A' and B', respectively. The real impedance values at these points, are approximately 15 ohms at point A' and 10 ohms at point B'.

Although the bottom surface is not illustrated in FIG. 14, it should be noted that in this particular embodiment there is no ground plane on the bottom surface of radiator section 204. There is a ground plane on the bottom surface of feed section 208, but it should be noted that the ground plane opposite 180° power divider may be altered as illustrated to allow the 90° and 180° signals to exchange relative positions, depending on the embodiment implemented.

Note that radiators 1304 change pitch in FIG. 13 where they extend beyond the length of radiators 104. This changing pitch is very useful for tailoring the radiation pattern of the antenna to allow the second frequency antenna pattern to be more efficient at coupling energy between the antenna and desired signal recipients, or sources. That is, changing the pitch of the antenna radiators alters the radiation pattern of the antenna which is used to adjust the radiation pattern commensurate with the expected use of the antenna, and characteristics of the communication system. It can also be used to adjust the radiation pattern of the second set of radiators to be more closely matched to that of the first set of radiators. Those skilled in the art will readily understand the changes needed to improve antenna operation within a given communication system.

Figure 16:
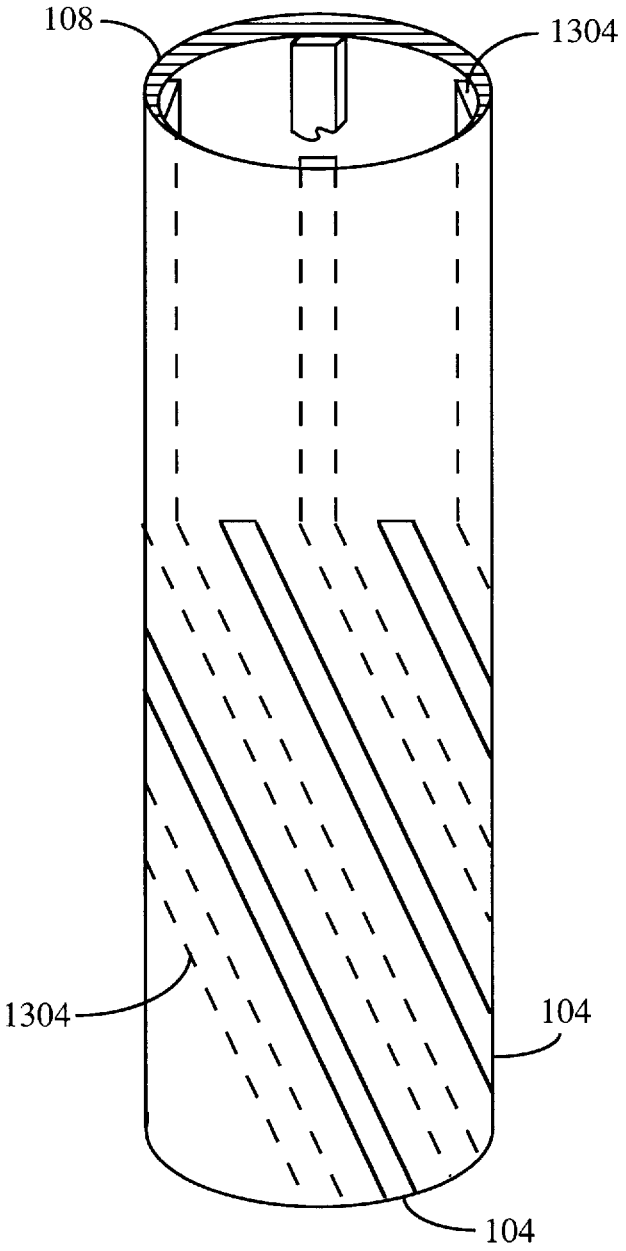
FIG. 16 illustrates one embodiment of a dual-band octafilar antenna using variable pitch on one set of radiators.
Figure 17:
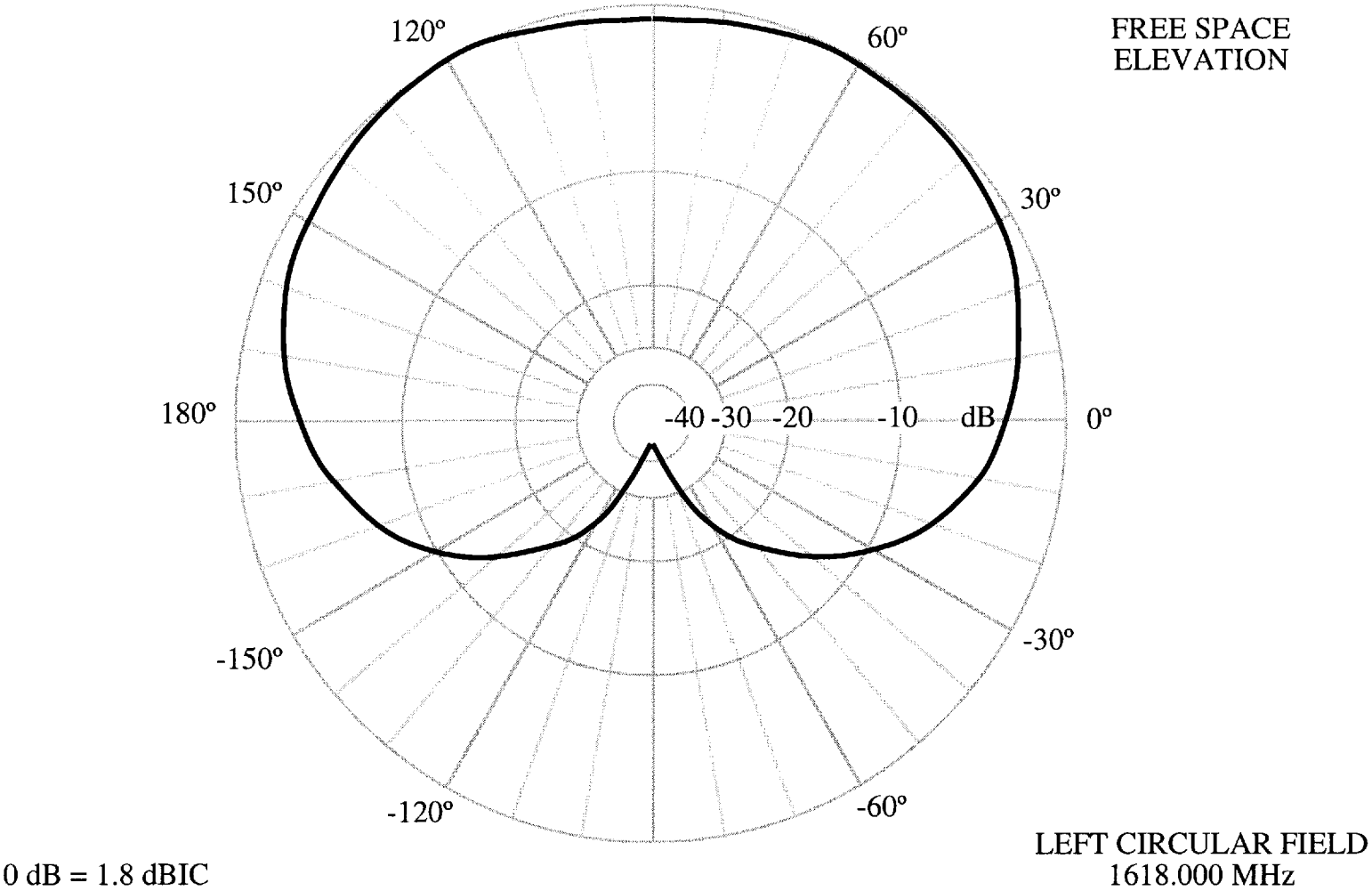
FIG. 17 illustrates a plot of a radiation pattern for the antenna of FIG. 16 at a lower frequency.
Figure 18:
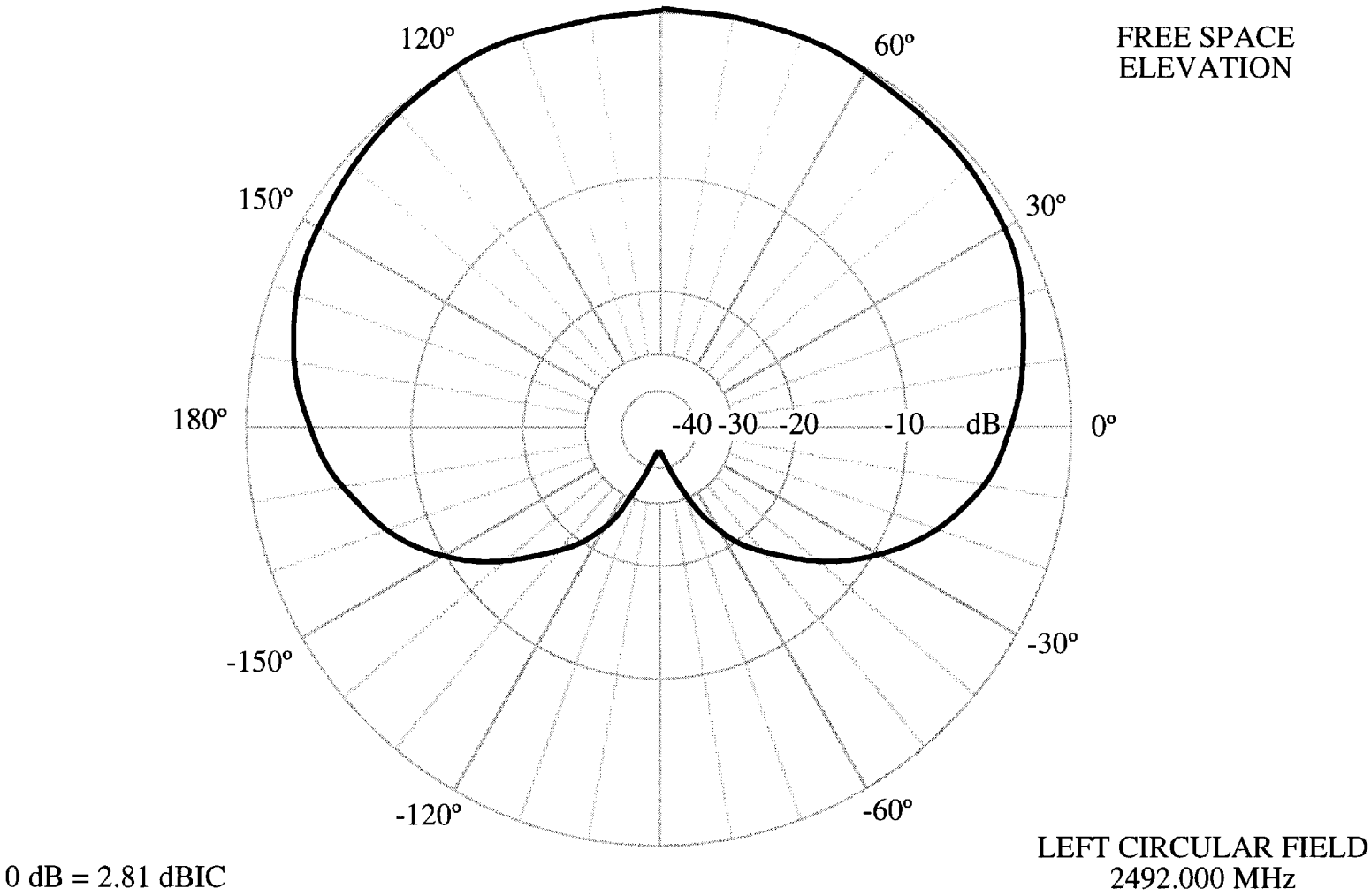
FIG. 18 illustrates a plot of a radiation pattern for the antenna of FIG. 16 at a higher frequency.

An exemplary antenna using pitch differential is illustrated in FIG. 16, along with the resulting radiation patterns, as simulated, in FIGS. 17 and 18. A cylindrical form radius of about 0.25 inches was used with the outer radiators having the length λ/2 at the 1.618 GHz and the inner radiators having the length λ/2 at 2.492 GHz. The radiator elements were modeled as being formed from approximately 100 mil wide conductive material on substrate 108. In FIG. 16, the inner helical radiators 1304 are illustrated as being longer and having a different pitch where they extend beyond the length of radiators 104. Radiators 1304 are shown in dashed lines since they are hidden inside the cylindrical substrate form.

Figure 19A:
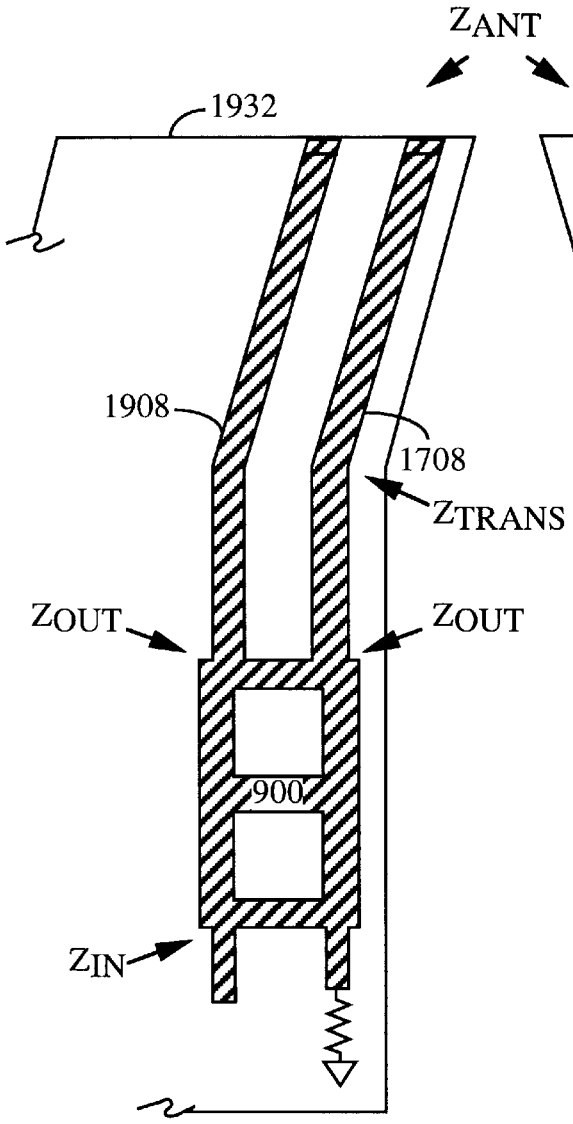
FIG. 19(*a*) illustrates a top surface of the substrate of a microstrip dual-band octafilar antenna having a dual-band feed network and impedance transformers according to an infinite balun feed embodiment.
Figure 19B:
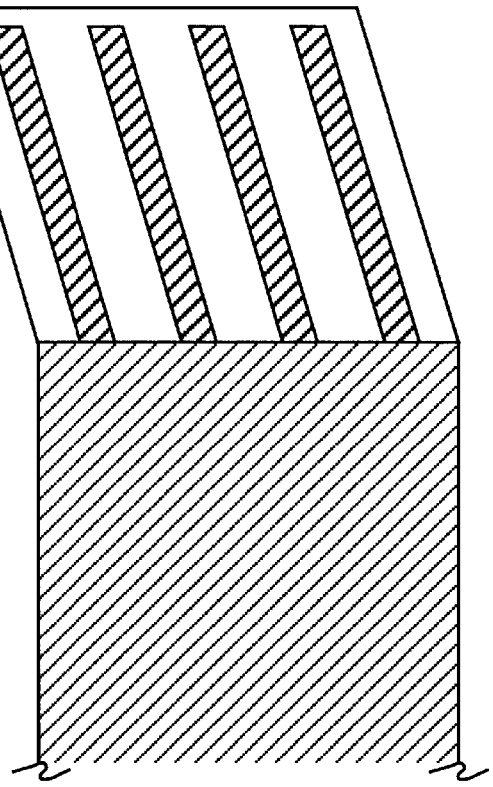

An infinite balun feed embodiment of a dual-band octafilar antenna is illustrated in FIG. 19, which comprises FIGS. 19(*a*) and 19(*b*). In this infinite balun feed embodiment, the feed lines are implemented as transformer sections 1908. Transformer sections 1908 are provided on feed section 208 and extend from double-section branch line coupler 900 to second end 1932 of radiator section 204. Passive radiators, although not illustrated in FIG. 19, are interleaved with active radiators 1904. Transformer sections 1908 provide two functions. They perform impedance matching for both active and passive radiators, and they act as feed lines for the infinite balun antenna.

Figure 20:
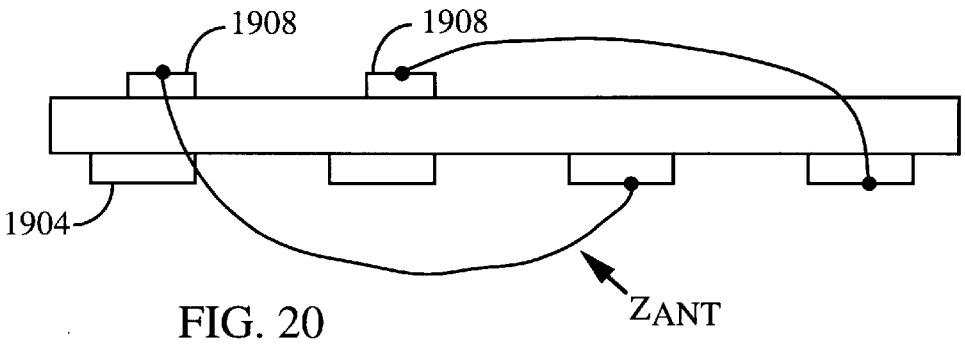
FIG. 20 illustrates an end view of the infinite balun feed embodiment illustrating the connection of transformer sections to radiators.

FIG. 20 is an end view of the infinite balun feed embodiment illustrating the connection of transformer sections 1908 to radiators 1904. Note that because the antenna is formed into a cylinder the actual connections will be made in a manner similar to that illustrated in FIG. 5.

For ease of discussion, the infinite balun feed embodiment illustrated in FIG. 19 is described in the context of the same example used to describe the embodiment illustrated in FIG. 14. In the infinite balun feed embodiment, transformer sections 1908 are implemented as having a length l≈λ/2 at 1.618 GHz, or 1 3λ/4 at 2.492 GHz. At this length, the transformer does not alter the impedance seen at 1.618 GHz, and therefore, $Z_{out}$ still matches $Z_{ant}$ at the feed point. However, for the 2.492 GHz frequency, because transformer 1404 is 3λ/4, transformer 1404 functions as a quarter-wave transformer.

Although not illustrated in FIGS. 19(*a*) and 19(*b*), in implementations of the octafilar antenna where active radiators 104 are λ/2 of the operating frequencies, the active radiators 104 are shorted together at the opposite end of the feed point. This can be accomplished by a number of techniques including the use of a shunt on the back surface of the microstrip substrate 108 connected to active radiators 104 using vias, or through the use of tabs similar to those illustrated in FIG. 5.

It should be noted that the layout diagrams provided herein are provided to illustrate the functionality of the components, and not necessarily to depict an optimum layout. Based on the disclosure provided herein, including that provided by the illustrations, optimum layouts are obtainable using standard layout optimization techniques, considering materials, power, space, and size constraints. However, example layouts are described below for branch line coupler 700 and 180° power divider 1100.

Figure 21:
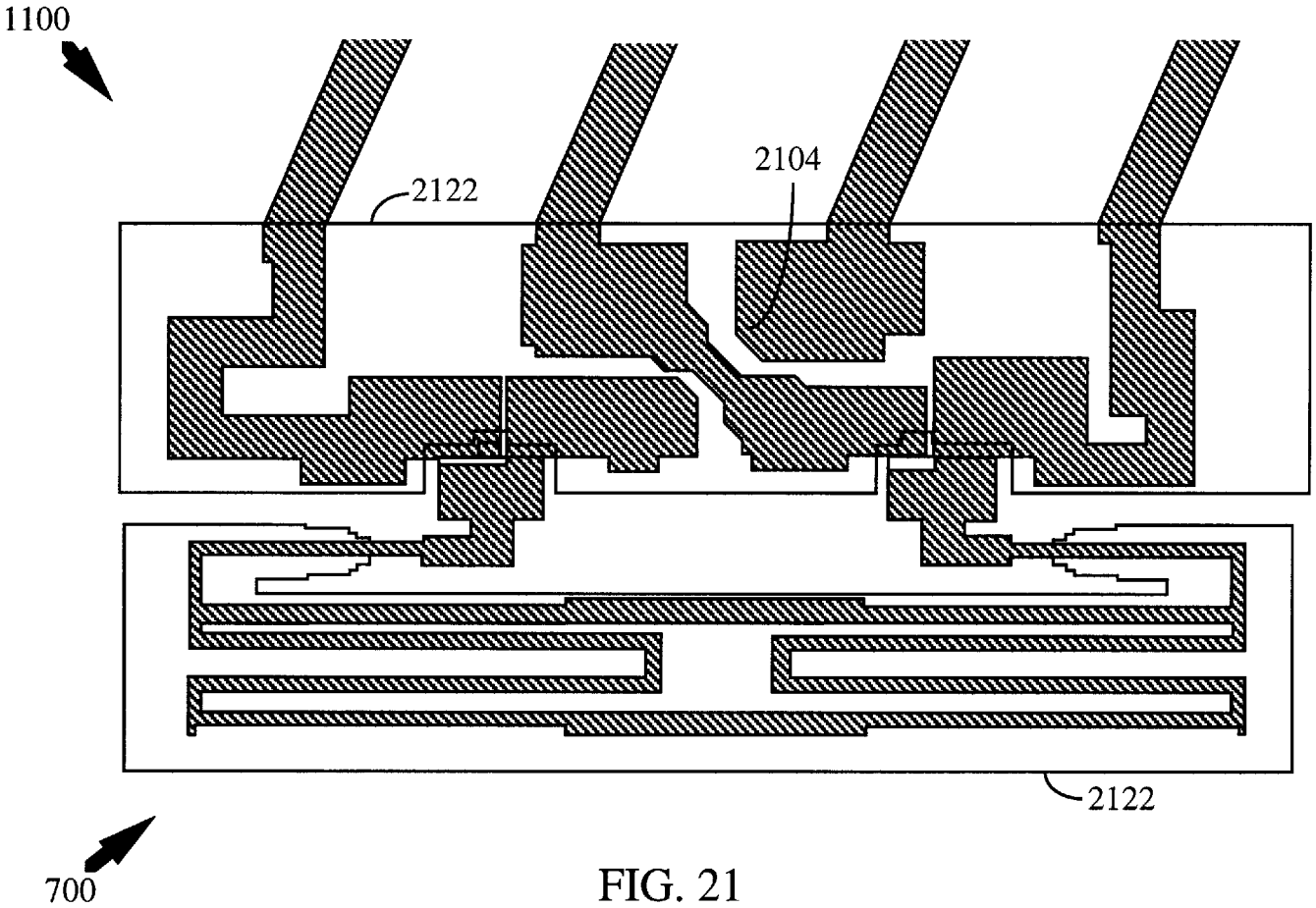
FIG. 21 illustrates an example implementation of a feed network having two 180° power dividers and a single-section branch-line coupler.

FIG. 21 is a layout diagram illustrating a layout for the feed network illustrated in FIG. 12. Referring now to FIG. 21, branch line coupler 700 is shown in a layout that is more area efficient than the configuration illustrated in FIG. 7. 180° power dividers 1100 are illustrated as having large traces at interface areas to increase the capacitance and decrease the characteristic impedance. Also illustrated in FIG. 21 is a cross-over section 2104 where the 90° and 180° signals are crossed. Solid outlines without hashing 2122 illustrate an outline of the traces on bottom surface 200. The hashed areas indicate the traces on top surface 300.

FIG. 22 illustrates an example layout of active elements in a quadrifilar helix antenna using the feed network 308 illustrated in FIG. 21. Note that in this embodiment, radiators 104 are shorted at second end 234 by a shorting ring type conductor 2204.

The use of a single feed or electrical signal connection for coupling input signals into, or out of, the octafilar antenna or antenna feed structure was described in FIGS. 12–21. However, even though less efficient for some applications, it may be advantageous to use a dual feed connection. Such a feed structure does reduce impedance matching issues and signal crosstalk, while simplifying antenna tuning.

Figure 23:
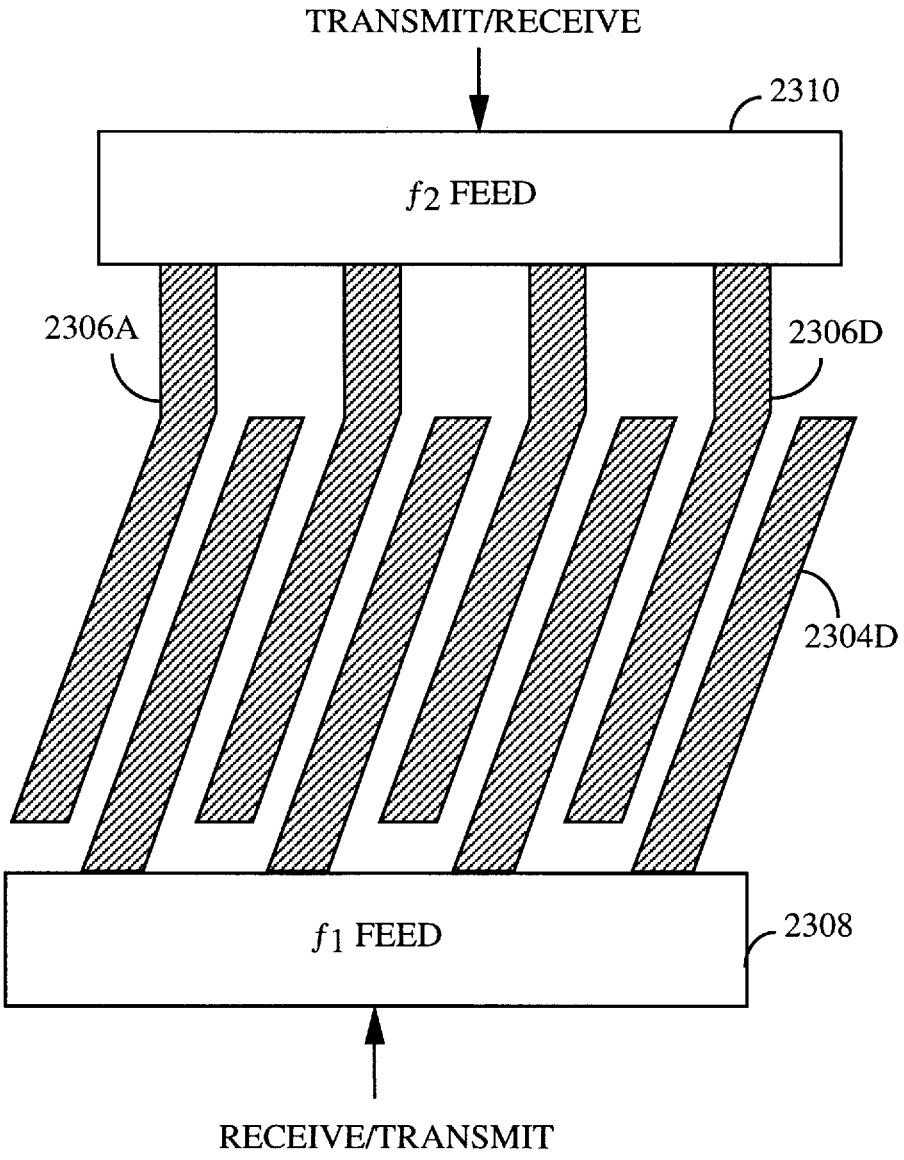
FIG. 23 illustrates a dual-feed dual-band octafilar antenna according to one embodiment of the invention.
Figures 24A, 24B, 24C:
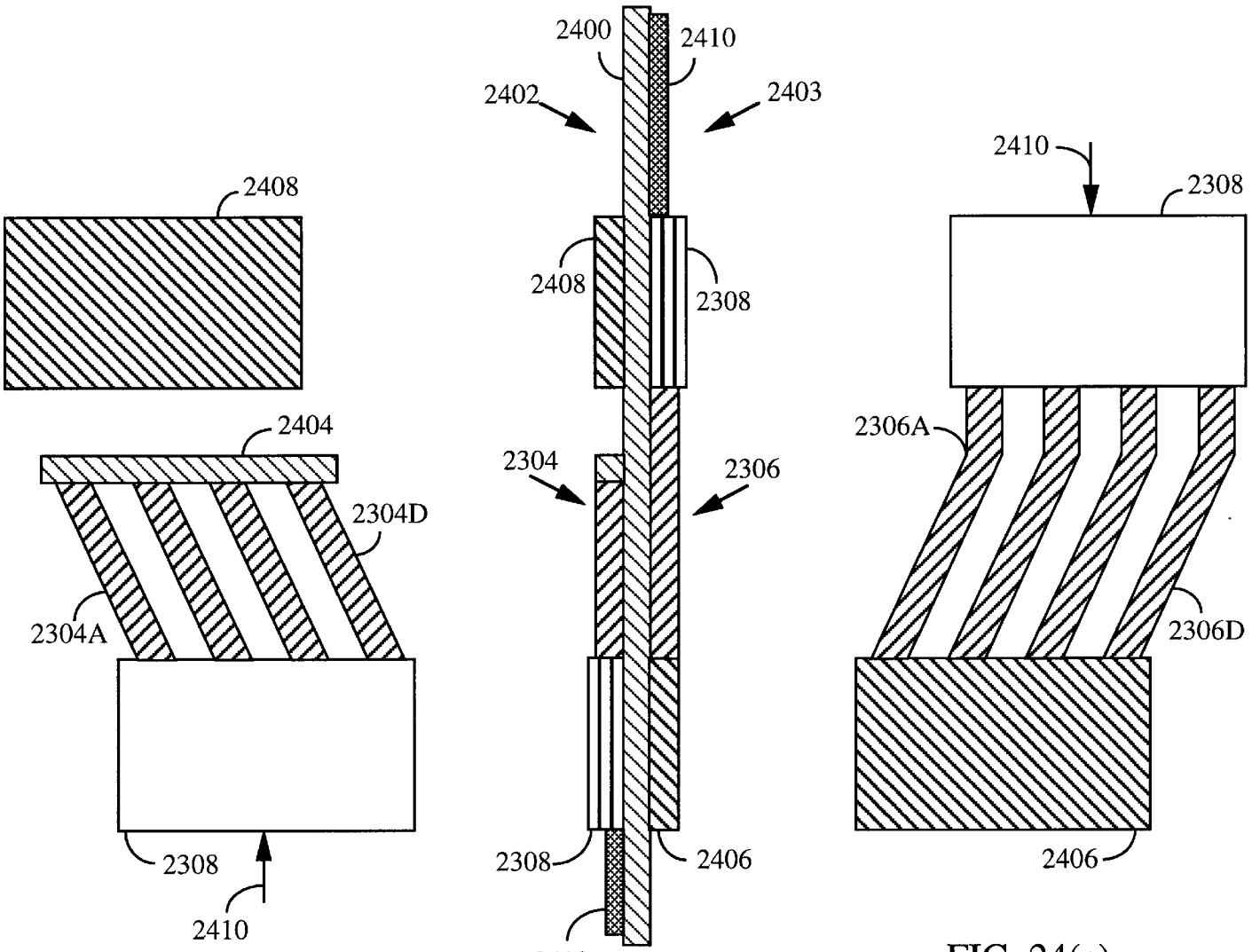
FIGS. 24(*a*), 24(*b*), and 24(*c*) illustrate top, cross-sectional, and bottom views, respectively, of an antenna structure implementing the octafilar antenna of FIG. 23 on opposing sides of a single support substrate.
Figure 25C:
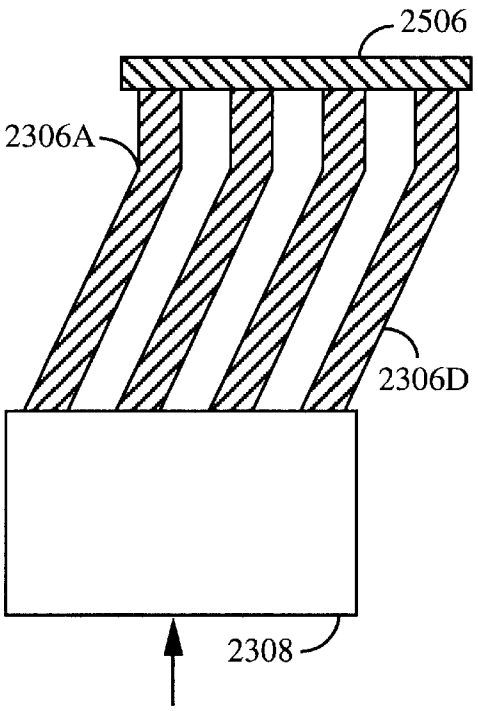
FIGS. 25(*a*), 25(*b*), and 25(*c*) illustrate top, cross-sectional, and bottom views, respectively, of an antenna structure implementing the octafilar antenna of FIG. 23 on a multiple layer support substrate.
Figure 25B:
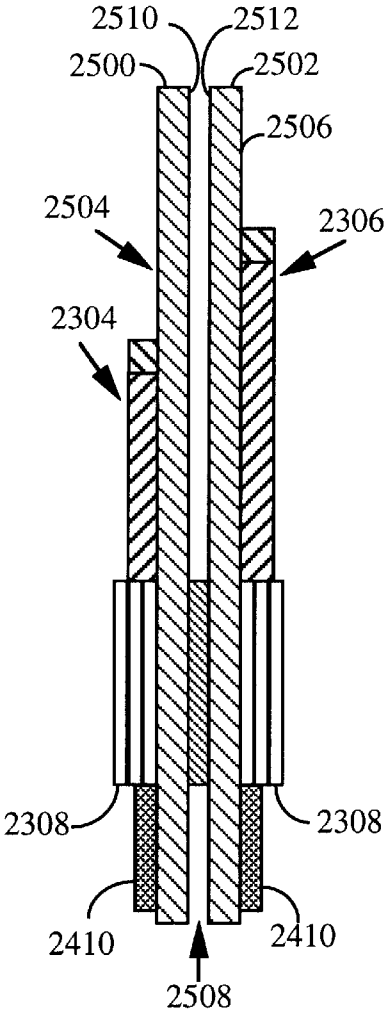
Figure 25A:
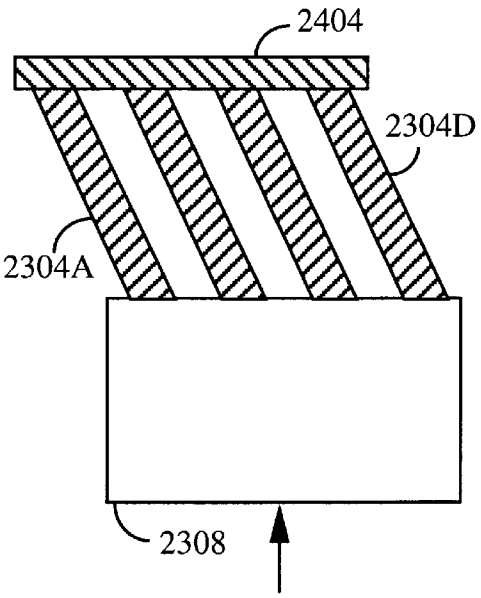

A multiple feed structure is shown in FIGS. 23–25 where each quadrifilar section of the octafilar antenna is fed separately. Extended variable pitch radiators similar to those in FIGS. 13 and 16 are used for illustration, although not required for implementing the present invention. For a single support substrate having both sets of antenna radiators formed on one surface, a dual feed might be illustrated conceptually as in FIG. 23 where the feed networks 2308 and 2310 are used to feed sets of radiators 2304 and 2306, respectively. However, one set of radiators can be formed on the bottom surface of the substrate to prevent electrical connections between the sets of radiators, when the length is a multiple of $\lambda/2$ and one end is shorted. That is, to allow the formation of an electrical conductor across the top ends of the radiators without complex insulating layers or such.

This structure can be implemented as shown in FIGS. 24(*a*), 24(*b*), and 24(*c*), where two sets of radiators 2304 and 2306 are formed on opposing surfaces 2402 and 2403 of a support substrate 2400, and fed accordingly by two feed networks 2308. In FIG. 24(*a*), the shorter radiators 2304 are shown as being formed on surface 2402 with a corresponding feed network 2308 positioned adjacent to one end and a shorting conductor 2404 extending between radiators on the other end. A planar conductor or ground plane material 2408 is positioned a short distance from the ends of radiators 2304. The separation distance is substantially equal to the difference in length between the shorter and longer radiators.

In FIG. 24(*c*), the longer wavelength section or longer radiators 2306 are formed on the opposite surface, 2403, of substrate 2400 with a corresponding feed network 2308 positioned adjacent to one end and a shorting conductor 2406 extending between radiators on the other end. Shorting conductor 2406 is a larger planar structure that also forms a second ground plane. Ground plane 2406 is positioned on the opposite side of substrate 2400 from the feed network 2308 for radiators 2304, and ground plane 2408 is positioned on the opposite side of substrate 2400 from the feed network 2308 for radiators 2306.

In FIG. 24(*b*), two input signal conductors 2410 are shown positioned on substrate 2400 adjacent and connected to feed networks 2308. The networks are shown as having greater thickness solely for purposes of clarity in illustration. Ground planes 2406 and 2408 act as the appropriate ground planes for feed networks 2308 as discussed above, and would be constructed accordingly.

In the alternative, a multi-layer substrate or multiple-substrate package may be used to manufacture the antenna of FIG. 24. This is accomplished by placing a layer of conductive material "between" the feed networks of the two radiator sections that are otherwise on opposite surfaces of the overall support substrate structure. One method of accomplishing this is shown in FIGS. 25(*a*), 25(*b*), and 25(*c*). Here, two sets of radiators 2304 and 2306 are formed on outer surfaces of two support substrates 2500 and 2502, respectively, which are then mounted next to each other on opposite sides of a conductive ground plane.

In FIG. 25(*a*), the shorter radiators 2304 are shown as being formed on a surface 2504 of substrate 2500, along with a corresponding feed network 2308 and a shorting conductor 2404. In FIG. 24(*c*), the longer wavelength section or longer radiators 2306 are shown as being formed on a surface 2506 of substrate 2502, along with a feed network 2308 and a shorting conductor 2506. Note that shorting conductor 2506 is no longer a large ground plane.

Substrates 2500 and 2502 are secured or bonded together using one of a variety of techniques well known in the art, along inner surfaces 2510 and 2512. This can be accomplished using a variety of bonding agents, or intermediate layers of material known in the art, to manufacture the substrates, and so forth. The result is a composite multi-layered support structure that sandwiches conductive material 2508 in between the two substrates. Material 2508 is positioned adjacent to and on opposite sides from both feed networks 2308, where it acts as a planar ground for those networks.

In FIG. 25(*b*), two input signal conductors 2410 are also shown positioned on substrates 2500 and 2502 adjacent and connected to feed networks 2308. The networks are shown as having greater thickness solely for purposes of clarity in illustration.

6. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

For example, it will be apparent to a person skilled in the relevant art that although the various ground planes disclosed are illustrated as solid ground planes, other ground configurations may be utilized depending on the antenna and/or feed network implemented. Other ground configurations can include, for example, ground meshes, perforated ground planes and the like. At the same time, other feed network devices or assemblies might be used to transfer signals to or from the radiators as desired by antenna designers.

What we claim as the invention is:

1. A dual-band octafilar helix antenna, comprising:

a first set of four helical radiators matched to a first frequency and disposed on a radiator portion of a support substrate;

a second set of four helical radiators matched to a second frequency and disposed on said radiator portion of said support substrate and interleaved with said first set of radiators;

wherein one of said first and second sets of radiators has a greater length than the other and uses a variable pitch for the helical shape along the portion of its length which extends beyond said other set of radiators; and at least one feed network formed on a feed portion of said support substrate providing 0°, 90°, 180° and 270° signals to at least one of said first and second sets of radiators.

2. The dual-band antenna of claim 1 wherein said support substrate is a microstrip substrate.

3. The dual-band antenna of claim 1, wherein said first and second sets of radiators comprise actively driven and passively driven radiators, respectively, with said active radiators being driven by said feed network, and said passive radiators being driven by said active radiators.

4. The dual-band antenna of claim 1, wherein said antenna is a dual feed antenna with both said first and second sets of radiators being actively driven by at least one feed network each.

5. The dual-band antenna of claim 4, wherein said first and second sets of radiators are positioned on opposing surfaces of said support substrate along with their associated feed network.

6. The dual-band antenna of claim 4, wherein:

said first set of radiators is positioned on a first surface of a first support substrate layer having a second parallel and opposing surface;

said second set of radiators is positioned on a first surface of a second support substrate layer having a second parallel and opposing surface;

said first and second support substrate layers being joined together into a single support substrate structure along each respective second surface, with said first and second sets of radiators residing on outer surfaces thereof; and a ground plane of predetermined size disposed along said second parallel and opposing surfaces of, and between, said first and second substrate layers.

7. The dual-band antenna of claim 1 wherein each feed network comprises:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°.

8. The dual-band antenna of claim 7, wherein said first and second power dividers each comprise:

a substrate;

a first conductive path disposed on a first surface of said substrate; and a ground portion disposed on a second surface of said substrate forming a ground plane that tapers from a larger width to a second conductive path having a width substantially equal to that of said first conductive path and being positioned on said second surface substantially in alignment with said first conductive path.

9. The dual-band antenna of claim 7 wherein said branch line coupler is a single section branch line coupler.

10. The dual-band antenna of claim 7 wherein said branch line coupler is a double section branch line coupler.

11. The dual-band antenna of claim 1 wherein each feed network comprises:

a power divider for providing from an input signal first and second output signals that differ from each other by 180°;

a first branch line coupler having an input arm for accepting said first output signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a third output arm for providing a fifth output signal and a fourth output arm for providing a sixth output signal, wherein said fifth and sixth output signals differ from one another by 90°.

12. The antenna of claim 11, further comprising four transformers disposed on said substrate and connecting said radiators to said first, second, third, and fourth output arms of said first and second branch line couplers.

13. The antenna of claim 12, wherein one of said first and second frequencies is approximately one and a half times the other and the length of said transformers is approximately $\lambda/2$ of one of said frequencies and $3\lambda/4$ of the other frequency.

14. The dual-band antenna of claim 1, wherein said first and second sets of radiators are positioned on opposing surfaces of said support substrate along with their associated feed network.

15. A dual-band octafilar helix antenna, comprising:

a set of four active radiators matched to a first frequency and disposed on a radiator portion of a microstrip substrate;

a set of four passive radiators matched to a second frequency and disposed on said radiator portion of said microstrip substrate and interleaved with said active radiators, said passive radiators being driven by said active radiators; and at least one feed network formed on a feed portion of said microstrip substrate providing 0°, 90°, 180° and 270° signals to said set of active radiators.

16. The antenna of claim 15, wherein said feed network comprises:

a power divider for providing from an input signal, first and second output signals that differ from each other by 180°;

a first branch line coupler having an input arm for accepting said first signal from said power divider and further having a first output arm for providing a third output signal and a second output arm for providing a fourth output signal, wherein said third and fourth output signals differ from one another by 90°; and a second branch line coupler having an input arm for accepting said second output signal from said power divider and further having a first output arm for providing a fifth output signal and a second output arm for providing a sixth output signal, wherein said fifth and sixth output signals differ from one another by 90°.

17. The dual-band antenna of claim 16 wherein each branch line coupler is a double section branch line coupler.

18. The antenna of claim 16, further comprising four transformers disposed on said substrate and connecting said third, fourth, fifth and sixth output signals from said branch line couplers to said active radiators.

19. The antenna of claim 18, wherein one of said first and second frequencies is approximately one and a half times the other and the length of said transformers is approximately $\lambda/2$ of one of said frequencies and $3\lambda/4$ of the other frequency.

20. The dual-band antenna of claim 15 wherein each feed network comprises:

a branch line coupler having an input arm for accepting an input signal and a first output arm for providing a first output signal and a second output arm for providing a second output signal, wherein said first and second output signals differ from one another by 90°;

a first power divider connected to said first output of said branch line coupler for accepting said first output signal and for providing therefrom third and fourth output signals, wherein said third and fourth output signals differ from one another by 180°; and a second power divider connected to said second output of said branch line coupler for accepting said second output signal and for providing therefrom fifth and sixth output signals, wherein said fifth and sixth output signals differ from one another by 180°.

21. The dual-band antenna of claim 15, wherein said set of active radiators and said set of passive radiators are positioned on the opposing surface of said support substrate, along with their associated feed network.

22. The dual-band antenna of claim 15, wherein:

said set of active radiators and its associated feed network are positioned on a first surface of a first support substrate layer having a second parallel and opposing surface; and said set of passive radiators is positioned on a first surface of a second support substrate layer having a second parallel and opposing surface;

said first and second support substrate layers being joined together into a single support substrate structure along each respective second surface, with said first and second sets of radiators residing on outer surfaces thereof; and a ground plane of predetermined size disposed along said second parallel and opposing surfaces of, and between, said first and second substrate layers.

23. The dual-band antenna of claim 20, wherein said first and second power dividers each comprise:

a substrate;

a first conductive path disposed on a first surface of said substrate; and a ground portion disposed on a second surface of said substrate forming a ground plane that tapers from a larger width to a second conductive path having a width substantially equal to that of said first conductive path and being positioned on said second surface substantially in alignment with said first conductive path.

24. The dual-band antenna of claim 20 wherein said branch line coupler is a single section branch line coupler.

25. The dual-band antenna of claim 20 wherein said branch line coupler is a double section branch line coupler.

26. The dual-band antenna of claim 15, wherein one of said sets of active or passive radiators has a greater length than the other and uses a variable pitch for the helical shape along a portion of its length which extends beyond said other set.

* * * * *